US012352272B2

(12) United States Patent
Tomita et al.

(10) Patent No.: US 12,352,272 B2
(45) Date of Patent: Jul. 8, 2025

(54) SEALING MEMBER AND SUBMERGED PUMP SYSTEM

(71) Applicant: NIKKISO CO., LTD., Tokyo (JP)

(72) Inventors: Yasuo Tomita, Tokyo (JP); Motoyasu Ogawa, Tokyo (JP); Masaaki Eguchi, Saitama (JP)

(73) Assignee: NIKKISO CO., LTD., Tokyo (JP)

( * ) Notice: Subject to any disclaimer, the term of this patent is extended or adjusted under 35 U.S.C. 154(b) by 55 days.

(21) Appl. No.: 18/068,720

(22) Filed: Dec. 20, 2022

(65) Prior Publication Data

US 2023/0204036 A1 Jun. 29, 2023

(30) Foreign Application Priority Data

Dec. 27, 2021 (JP) ..... 2021-213276

(51) Int. Cl.

| | |
|---|---|
| ***F04B 45/02*** | (2006.01) |
| ***F04B 23/02*** | (2006.01) |
| ***F04D 13/08*** | (2006.01) |
| ***F04D 13/16*** | (2006.01) |
| ***F04D 29/08*** | (2006.01) |

(52) U.S. Cl.

CPC ..... *F04D 13/086* (2013.01); *F04B 23/021* (2013.01); *F04B 45/02* (2013.01); *F04D 13/16* (2013.01); *F04D 29/086* (2013.01)

(58) Field of Classification Search

CPC ..... F04D 13/086; F04D 13/16; F04D 29/086; F04B 23/021; F04B 45/02; F17C 2227/0135; F17C 9/00; F16J 15/52; F16J 15/525; F16J 3/042

USPC ..... 417/361; 310/12.01–12.33; 62/50.6; 92/34–47; 277/122, 123

See application file for complete search history.

(56) References Cited

U.S. PATENT DOCUMENTS 3,773,266 A * 11/1973 Raefield ..... B05B 13/0405 239/243
4,537,385 A * 8/1985 Bragg ..... F16K 41/00 137/553
4,926,979 A * 5/1990 Odaka ..... F16D 55/227 188/73.44
5,384,998 A * 1/1995 Tanaka ..... A47B 83/001 52/630

(Continued)

FOREIGN PATENT DOCUMENTS

JP 2017-132619 A 8/2017

*Primary Examiner* — Philip E Stimpert
*Assistant Examiner* — Dnyanesh G Kasture
(74) *Attorney, Agent, or Firm* — WCF IP

(57) ABSTRACT

A sealing member according to the present invention includes a head plate having a through hole and attached to an opening end of a pump column, a lift shaft penetrating the through hole and raised and lowered between a raised position and a lowered position in raising and lowering the pump, and a bellows member extending and contracting corresponding to the raising and lowering of the lift shaft. The bellows member includes a bellows tube covering an outer peripheral surface of a protruding portion of the lift shaft protruding downward from the head plate, a first attaching member disposed contiguously to a lower end of the bellows tube and attached to a protruding lower portion, and a second attaching member disposed contiguously to an upper end of the bellows tube and attached to a lower surface of the head plate.

8 Claims, 9 Drawing Sheets

(56) References Cited

U.S. PATENT DOCUMENTS

| | | | | |
|---|---|---|---|---|
| 6,422,542 | B2 * | 7/2002 | Gramss | E05F 5/022 267/122 |
| 7,871,250 | B2 * | 1/2011 | Yajima | F04B 43/107 277/389 |
| 2015/0184645 | A1 * | 7/2015 | Johnson | F17C 13/06 62/45.1 |
| 2024/0353764 | A1 * | 10/2024 | Yi | G03F 7/70991 |

* cited by examiner

SEALING MEMBER AND SUBMERGED PUMP SYSTEM

TECHNICAL FIELD

The present invention relates to a sealing member and a submerged pump system.

BACKGROUND ART

A submerged pump system is used to remove liquefied gas from a storage tank in which the liquefied gas (liquefied natural gas, liquefied ammonia, etc.) is stored (for example, see JP2017-132619 A). A pump of the submerged pump system (submerged pump) is accommodated in a pump column that is provided extending from a ceiling of the storage tank into the liquefied gas and is submerged in the liquefied gas. A foot valve that opens under the own weight of the pump is attached to a lower end of the pump column. An upper end of the pump column is liquid-tightly sealed by a head plate. The head plate has a lift shaft, which allows the pump to be raised and lowered, attached penetrating the head plate. The lift shaft and the head plate are liquid-tightly sealed with a sealing material (e.g., gland seal) disposed between the lift shaft and the head plate.

In the submerged pump system, the pump is taken out of the storage tank for maintenance, for example. When the pump stops, the pump column is filled with residual liquefied gas and vaporized liquefied gas (vaporized gas). There is a technical problem that, when the head plate is removed in this state, the liquefied gas and the vaporized gas (hereinafter collectively referred to as "residual gas") leak to the outside. Since much of the residual gas is flammable and toxic, the residual gas needs to be removed prior to the removal of the head plate.

To remove the residual gas, a method of introducing an inert gas such as nitrogen into the pump column with the foot valve closed is used. In this method, the pump is raised by the lift shaft and the foot valve is closed prior to the introduction of the inert gas. In this case, in order to raise the lift shaft and close the foot valve, tightening to the sealing material is weakened in advance. As a result, the sealability of the sealing material decreases, and a small amount of residual gas may leak from a gap of the sealing material to the outside.

SUMMARY OF INVENTION

Technical Problem

An object of the present invention is to provide a sealing member and a submerged pump system capable of preventing leakage of residual gas in raising and lowering a pump.

Solution to Problem

A sealing member in one aspect of the present invention is a sealing member for sealing an opening end of a cylindrical pump column configured to accommodate a pump configured to be submerged in a handling liquid and for suspending and supporting the pump when the pump is raised and lowered in the pump column, the sealing member including: a head plate having a through hole extending in a vertical direction and attached to the opening end so as to close the opening end; a lift shaft disposed through the through hole and raised and lowered between a raised position and a lowered position when the pump is raised and lowered; and a bellows member that extends and contracts in an axial direction of the lift shaft corresponding to the raising and lowering of the lift shaft, in which the bellows member includes: a bellows tube covering an outer peripheral surface of a protruding lower portion of the lift shaft protruding downward from the head plate; a first attaching member disposed contiguously to a lower end of the bellows tube and attached to the protruding lower portion of the lift shaft; and a second attaching member disposed contiguously to an upper end of the bellows tube and attached to a lower surface of the head plate.

A submerged pump system in one aspect of the present invention includes: a pump configured to be submerged in a handling liquid; a cylindrical pump column configured to accommodate the pump; and the sealing member.

Advantageous Effects of Invention

The present invention is able to provide the sealing member and the submerged pump system capable of preventing leakage of residual gas in raising and lowering the pump.

DESCRIPTION OF EMBODIMENTS

Figure 1:
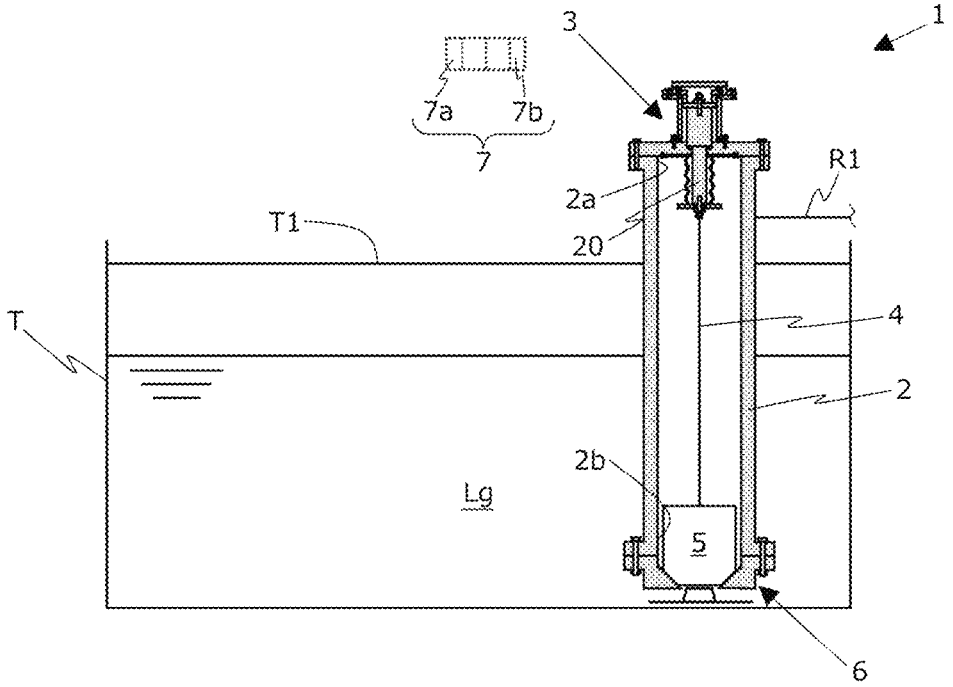
FIG. 1 is a schematic cross-sectional view of a submerged pump system illustrating a first embodiment of the submerged pump system according to the present invention.

Embodiments of a sealing member and a submerged pump system according to the present invention will be described below with reference to the drawings. In the drawings, the same members and components are indicated with the same reference signs, and repetitive description thereof will be omitted. In the drawings, a shape and size of each member are intentionally emphasized and illustrated more than the actual dimensions thereof in order to clarify the configuration of each member.

In the following description and drawings, "downward" is the direction of gravity, and "upward" is the opposite direction of downward.

Submerged Pump System (1)

First, an embodiment (first embodiment) of the submerged pump system according to the present invention will be described.

Configuration of Submerged Pump System (1)

FIG. 1 is a schematic cross-sectional view of the submerged pump system illustrating the first embodiment of the submerged pump system according to the present invention.

A submerged pump system 1 is attached to a storage tank T in which liquefied gas Lg is stored and feeds the liquefied gas Lg from the storage tank T to the outside. The submerged pump system 1 includes a pump column 2, a sealing member 3, a support cable 4, a submerged pump (hereinafter referred to as "pump") 5, a foot valve 6, and a color 7. In the present embodiment, the liquefied gas Lg is liquefied ammonia. The liquefied ammonia is an example of a handling liquid in the present invention.

Note that, in the present invention, the handling liquid is not limited to the liquefied ammonia. That is, for example, the handling liquid may be liquefied natural gas.

The pump column 2 accommodates the pump 5 and also functions as a liquid feeding path for the liquefied gas Lg discharged from the pump 5. The pump column 2 has a cylindrical shape. The Pump column 2 is disposed penetrating a ceiling T1 of the storage tank T and provided extending from the ceiling T1 into the liquefied gas Lg. A liquid feeding path R1 for the liquefied gas Lg is connected to an upper outer peripheral surface of the pump column 2.

The sealing member 3 liquid-tightly seals an upper opening end 2*a* of the pump column 2 and also, when the pump 5 is raised and lowered in the pump column 2, suspends and supports the pump 5 via the support cable 4. The sealing member 3 is an example of the sealing member according to the present invention, and a specific configuration thereof will be described later.

The support cable 4 suspends and supports the pump 5 when raising and lowering the pump 5 in the pump column 2. The support cable 4 is made of a metal wire, for example. The support cable 4 is connected to a lift shaft 20 described later and the pump 5.

The pump 5 discharges, into the pump column 2, the liquefied gas Lg flowing in from the foot valve 6. The pump 5 is, for example, a known submerged pump including a multi-stage centrifugal pump and a motor that drives the multi-stage centrifugal pump. The power of the pump 5 is supplied via a power cable (not illustrated) connected to the sealing member 3. The pump 5 is accommodated in a lower portion of the pump column 2 and is submerged in the liquefied gas Lg.

The foot valve 6 opens and closes a lower opening end 2*b* of the pump column 2. The foot valve 6 opens under the own weight of the pump 5 when the pump 5 is accommodated in the lower portion of the pump column 2, and the foot valve 6 closes by a biasing force of a spring (not illustrated) when the pump 5 is lifted.

The color 7 fixes the lift shaft 20 described later to a raised position described later. The color 7 is formed in a cylindrical shape by two half-cylindrical shaped members 7*a* and 7*b*. That is, the color 7 can be disassembled into the two half-cylindrical members 7*a* and 7*b*. The color 7 is a maintenance member used when the pump 5 is taken out, and the color 7 is not used when the pump 5 is in operation. Thus, in FIG. 1 and FIG. 5, the color 7 is illustrated with a dashed line.

Configuration of Sealing Member (1)

Next, a specific configuration of the sealing member 3 (the sealing member according to the present invention) will be described.

Figure 2:
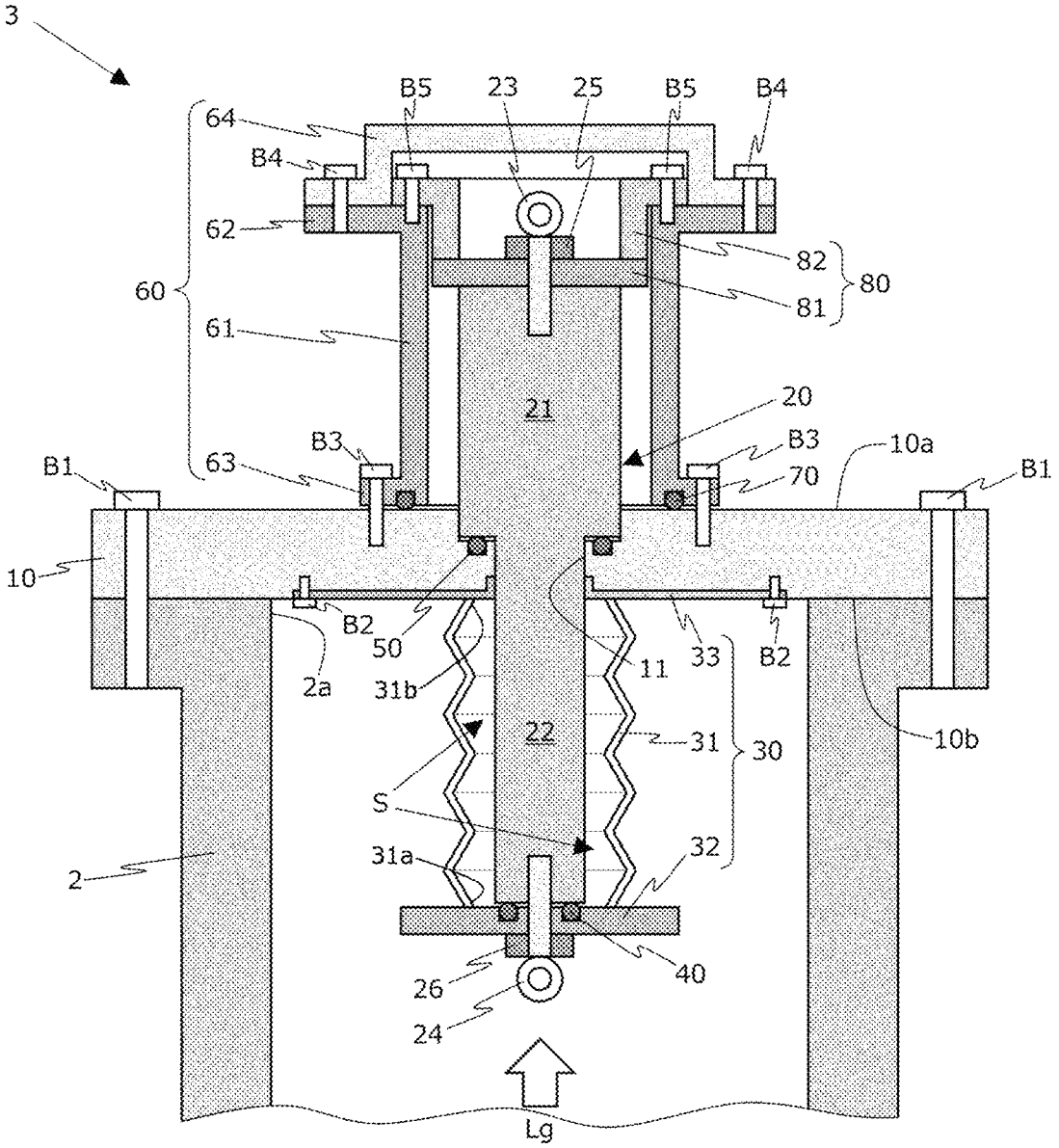
FIG. 2 is a schematic cross-sectional view of a sealing member in the first embodiment.

FIG. 2 is a schematic cross-sectional view of the sealing member 3 in the first embodiment.

Figure 3:
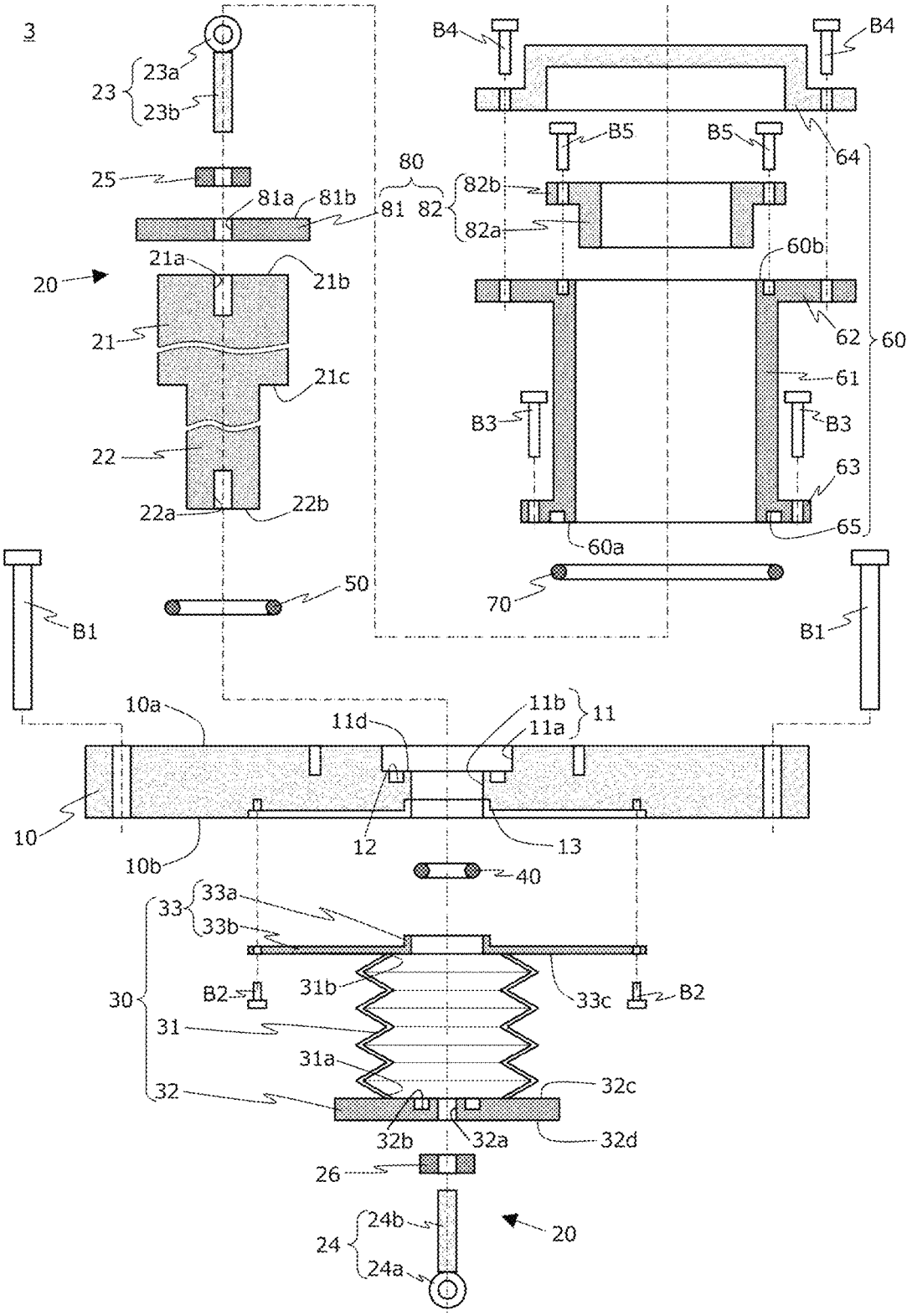
FIG. 3 is a schematic exploded cross-sectional view of the sealing member in FIG. 2.

FIG. 3 is a schematic exploded cross-sectional view of the sealing member 3.

FIG. 2 illustrates the sealing member 3 when the lift shaft 20 described later is located in a lowered position. FIG. 2 also illustrates an upper portion of the pump column 2 for convenience of description. In the following description, bolt holes corresponding to bolts B1 to B5 described later are a well-known technique, and the description thereof will be omitted. In the following description, FIG. 1 will be referred to as necessary.

The "lowered position" is a position (the position illustrated in FIG. 2 and FIG. 6) where the lift shaft 20 is lowered and a downward movement is restricted. In the present embodiment, the lowered position is a position where the downward movement of the lift shaft 20 is restricted by a lowering restricting member described later. The "raised position" is a position (the position illustrated in FIG. 4 and FIG. 7) where the lift shaft 20 is raised and the color 7 is attachable to the sealing member 3.

The sealing member 3 includes the head plate 10, the lift shaft 20, a bellows member 30, a first sealing member 40, a second sealing member 50, an upper housing 60, a third sealing member 70, a shaft fixing member 80, a plurality of plate attaching bolts B1, a plurality of bellows attaching bolts B2, a plurality of housing attaching bolts B3, a plurality of lid attaching bolts B4, and a plurality of pressing bolts B5.

The head plate 10 functions as a lid for closing the upper opening end 2*a* of the pump column 2. The head plate 10 has a disc shape, for example. The head plate 10 is made of metal such as stainless steel, for example. The head plate 10 includes an insertion hole 11, a seal groove 12, and a fitting portion 13.

The insertion hole 11 is a through hole that penetrates the head plate 10 in the vertical direction. That, is, the insertion hole 11 extends in the vertical direction in the head plate 10. The insertion hole 11 is disposed at the center of the head plate 10. The insertion hole 11 is an example of the through hole in the present invention. The insertion hole 11 includes a first hole portion 11*a*, a second hole portion 11*b*, and the fitting portion 13.

The first hole portion 11*a* is a circular hole into which a lower portion of a first shaft portion 21 described later of the lift shaft 20 is inserted when the lift shaft 20 is located in the lowered position. The second hole portion 11*b* is a circular hole through which a second shaft portion 22 described later of the lift shaft 20 is disposed. The first hole portion 11*a* is disposed contiguously to the second hole portion 11*b* above the second hole portion 11*b*. The first hole portion 11*a* is disposed concentrically with the second hole portion 11*b*. The inner diameter of the first hole portion 11*a* is larger than the inner diameter of the second hole portion 11*b*.

The seal groove 12 is a ring-shaped groove in which the second sealing member 50 is disposed. The seal groove 12 is disposed concentrically with the first hole portion 11*a* on a bottom surface lid of the first hole portion 11*a*.

The fitting portion 13 is a recess into which a second attaching member 33 of the bellows member 30 described later is fitted. On a lower surface 10*b* of the head plate 10, an area adjacent to the insertion hole 11 is recessed in a cylindrical shape, and an area adjacent to the recess is recessed in a ring plate shape, thereby forming the fitting portion 13. That is, the fitting portion 13 is formed by a part of the lower surface 10*b* and is disposed adjacent to the through hole 11 on the lower surface 10*b*. In the vertical direction, the length (the depth) of the cylindrical-shaped recess is larger (deeper) than the length (the depth) of the ring plate-shaped recess.

The lift shaft 20 is raised and lowered between the raised position and the lowered position when the pump 5 is raised and lowered and supports the pump 5 via the support cable 4. The lift shaft 20 includes the first shaft portion 21, the second shaft portion 22, a first connecting member 23, a second connecting member 24, a first nut member 25, and a second nut member 26.

The first shaft portion 21 restricts the downward movement of the lift shaft 20 lower than the lowered position. The second shaft portion 22 guides the raising and lowering of the lift shaft 20 together with the second hole portion 11*b* of the head plate 10 and a tube portion 33*a* described later. The first shaft portion 21 and the second shaft portion 22 have a columnar shape long in the vertical direction. The first shaft portion 21 is disposed contiguously to the second shaft portion 22 above the second shaft portion 22 and is integrally formed with the second shaft portion 22. That is, the first shaft portion 21 and the second shaft portion 22 constitute one shaft body. The first shaft portion 21 is disposed concentrically with the second shaft portion 22. The outer diameter of the first shaft portion 21 is larger than the outer diameter of the second shaft portion 22 and slightly smaller than the inner diameter of the first hole portion 11*a*. The outer diameter of the second shaft portion 22 is slightly smaller than the inner diameters of the second hole portion 11*b* and the tube portion 33*a*.

The first shaft portion 21 includes an internal thread hole 21*a*. The internal thread hole 21*a* opens on an upper end surface 21*b* of the first shaft portion 21 along the vertical direction.

The second shaft portion 22 includes a first internal thread hole 22*a*. The first internal thread hole 22*a* opens on a lower end surface 22*b* of the second shaft portion 22 along the vertical direction.

The first connecting member 23 is a member to which a cable (not illustrated) from a lift (not illustrated) is connected when the pump 5 is raised and lowered. The first connecting member 23 includes a ring-shaped connecting portion 23*a* and an external thread portion 23*b* extending downward from the connecting portion 23*a*. The first connecting member 23 is attached to the upper end of the first shaft portion 21 by screwing the external thread portion 23*b* into the internal thread hole 21*a*.

The second connecting member 24 is a member to which the support cable 4 is connected. The second connecting member 24 includes a ring-shaped connecting portion 24*a* and an external thread portion 24*b* extending upward from the connecting portion 24*a*. The second connecting member 24 is attached to the lower end of the second shaft portion 22 by screwing the external thread portion 24*b* into the first internal thread hole 22*a*.

The first nut member 25 fixes a receiving member 81 described later to the upper end surface 21*b* of the first shaft portion 21. The first nut member 20 is attached to the external thread portion 23*b* of the first connecting member 23.

The second nut member 26 presses a first attaching member 32 described later toward the lower end surface 22*b* of the second shaft portion 22. The second nut member 26 is attached to the external thread portion 24*b* of the second connecting member 24.

The lift shaft 20 is inserted through the insertion hole 11 of the head plate 10 from above and is disposed penetrating the insertion hole 11. The lift shaft 20 can be raised and lowered between the lowered position and the raised position when the pump 5 is raised and lowered.

When the lift shaft 20 is located in the lowered position, the lower portion of the first shaft portion 21 is disposed into the first hole portion 11*a* and the second shaft portion 22 is disposed through the second hole portion 11*b* and the tube portion 33*a*. In this case, the first shaft portion 21 protrudes above the head plate 10 and the second shaft portion 22 protrudes below (in the pump column 2) the head plate 10. In contrast, when the lift shaft 20 is located in the raised position, the first shaft portion 21 is located above the head plate 10. The second shaft portion 22 is disposed through the first hole portion 11*a*, the second hole portion 11*b*, and the tube portion 33*a* and protrudes out of the head plate 10 in the vertical direction.

The bellows member 30 extends and contracts in the axial direction (the vertical direction) of the lift shaft 20 corresponding to the raising and lowering of the lift shaft 20 and also liquid-tightly seals between the head plate 10 and the lift shaft 20. The bellows member 30 includes a bellows tube 31, the first attaching member 32, and the second attaching member 33.

The bellows tube 31 extends and contracts corresponding to the raising and lowering of the lift shaft 20. The bellows tube 31 is a cylindrical-shaped bellows with ring-shaped crest portions and root portions continued in the vertical direction. The bellows tube 31 is made of metal such as stainless steel, for example. The inner diameter of the bellows tube 31 (the inner diameter of the root portion) is larger than the outer diameter of the second shaft portion 22 of the lift shaft 20.

The first attaching member 32 attaches the bellows tube 31 to the lift shaft 20 (a protruding lower portion described later). The first attaching member 32 is disposed contiguously to a lower end 31*a* of the bellows tube 31 below the bellows tube 31. The first attaching member 32 has a ring plate shape. The first attaching member 32 includes an insertion hole 32*a* and a seal groove 32*b*. The outer diameter of the first attaching member 32 is larger than the outer diameter of the bellows tube 31.

The insertion hole 32*a* is a through hole that penetrates the first attaching member 32 in the vertical direction. The insertion hole 32*a* is disposed at the center of the first attaching member 32. The inner diameter of the insertion hole 32*a* is smaller than the outer diameter of the second shaft portion 22 and larger than the outer diameter of the external thread portion 24*b* of the second connecting member 24.

The seal groove 32*b* is a ring-shaped groove in which the first sealing member 40 is disposed. The seal groove 32*b* is disposed concentrically with the insertion hole 32*a* on an upper surface 32*c* of the first attaching member 32.

The second attaching member 33 attaches the bellows tube 31 to the head plate 10. The second attaching member 33 is disposed contiguously to an upper end 31*b* of the bellows tube 31 above the bellows tube 31. The second attaching member 33 includes the tube portion 33*a* and a flange portion 33*b*.

The tube portion 33*a* has a cylindrical shape. The inner diameter of the tube portion 33*a* is approximately the same as the inner diameter of the second hole portion 11*b*. With respect to the outer diameter dimension of the lift shaft 20 (the second shaft portion 22), a dimensional tolerance (a gap) of the inner diameter of the tube portion 33*a* is smaller than a dimensional tolerance of the inner diameter of the second hole portion 11*b*. As a result, the second shaft portion 22 is guided by the tube portion 33*a*, and thus the lift shaft 20 can be raised and lowered smoothly without rattling. In the radial direction of the tube portion 33*a*, a lower half portion of the tube portion 33*a*. protrudes outward and constitutes the ring plate-shaped flange portion 33*b*. That is, the tube portion 33*a* and the flange portion 33*b* are integrally formed. The outer diameter of the second attaching member 33 (the outer diameters of the tube portion 33*a* and the flange portion 33*b*) is approximately the same as the inner diameter of the fitting portion 13 of the head plate 10 (large by the amount of fit tolerance).

The lower end 31*a* of the bellows tube 31 is liquid-tightly welded to the upper surface 32*c* of the first attaching member 32 over the entire circumference of the bellows tube 31 in the circumferential direction. The upper end 31*b* of the bellows tube 31 is liquid-tightly welded to a lower surface 33*c* of the second attaching member 33 over the entire circumference of the bellows tube 31 in the circumferential direction. As a result, the bellows tube 31, the first attaching member 32, and the second attaching member 33 are integrally formed. In the radial direction of the first attaching member 32, the seal groove 32*b* is disposed inward of the lower end 31*a* of the bellows tube 31.

The second attaching member 33 is liquid-tightly fitted into the fitting portion 13, and thus the bellows tube 31 is attached to the lower surface 10*b* of the head plate 10. The second attaching member 33 is pressed toward the head plate 10 by the bellows attaching bolts B2. The bellows tube 31 accommodates a part of the lift shaft 20 protruding downward from the head plate 10 (hereinafter referred to as "protruding lower portion") and covers an outer peripheral surface thereof. The protruding lower portion is a part of the second shaft portion 22, and the length thereof varies depending on the raising and lowering of the lift shaft 20. A space surrounded by the bellows tube 31 (hereinafter referred to as "bellows internal space S") exists between the bellows tube 31 and the lift shaft 20. The bellows internal space S allows variation in the inner diameter (the outer diameter) of the bellows tube 31 with extension and contraction of the bellows tube 31.

The external thread portion 24*b* of the second connecting member 24 is disposed through the insertion hole 32*a*. The second nut member 26 and the connecting portion 24*a* of the second connecting member 24 are disposed below the first attaching member 32. The second nut member 26 abutting on a lower surface 32*d* of the first attaching member 32 is tightened, and thus the first attaching member 32 is pressed upward (toward the second shaft portion 22) and is attached to the lower end surface 22*b* of the second shaft portion 22 (the protruding lower portion).

The first sealing member 40 is an O-ring made of fluororesin, for example. The first sealing member 40 is disposed in the seal groove 32*b* of the first attaching member 32. The first sealing member 40 is disposed between the lower end surface 22*b* of the second shaft portion 22 and the upper surface 32*c* (the seal groove 32*b*) of the first attaching member 32 and liquid-tightly seals therebetween. The sealability of the first sealing member 40 is determined by the tightening force of the second nut member 26. That is, the sealability is deteriorated when the second nut member 26 is loosened, and the sealability is improved when the second nut member 26 is tightened. The first sealing member 40 is an example of a bellows sealing member in the present invention.

The second sealing member 50 is an O-ring made of fluororesin, for example. The second sealing member 50 is disposed in the seal groove 12 of the head plate 10. When the lift shaft 20 is located in the lowered position, the second sealing member 50 is disposed between the bottom surface 11*d* (the seal groove 12) of the first hole portion 11*a* and a lower end surface 21*c* of the first shaft portion 21 and liquid-tightly seals therebetween. The sealability of the second sealing member 50 is determined by the tightening force of the pressing bolts B5 described later. That is, the sealability is deteriorated when the pressing bolts B5 are loosened, and the sealability is improved when the pressing bolts 135 are tightened. The second sealing member 50 is an example of a shaft sealing member in the present invention.

The upper housing 60 accommodates a part of the lift shaft 20 protruding upward from the head plate 10 (hereinafter referred to as "protruding upper portion") when the lift shaft 20 is located in the lowered position. The protruding upper portion is the first shaft portion 21. The upper housing 60 includes a tube portion 61, a first flange portion 62, a second flange portion 63, a lid portion 64, and a seal groove 65.

The tube portion 61 has a cylindrical shape. The inner diameter of the tube portion 61 is larger than the outer diameter of the first shaft portion 21 and smaller than the outer diameter of the color 7. In the radial direction of the tube portion 61, an upper end portion of the tube portion 61 protrudes outward and constitutes the ring plate-shaped first flange portion 62. A lower end portion of the tube portion 61 protrudes outward and constitutes the ring plate-shaped second flange portion 63. That is, the tube portion 61, the first flange portion 62, and the second flange portion 63 are integrally formed.

The lid portion 64 protects the inside of the tube portion 61 from wind, rain, and the like. The lid portion 64 has a hat shape. The lid portion 64 is fastened to the first flange portion 62 of the tube portion 61 with the lid attaching bolts B4, and thus the lid portion 64 covers an upper opening of the tube portion 61.

The seal groove 65 is a ring-shaped groove in which the third sealing member 70 is disposed. The seal groove 65 is disposed concentrically with the tube portion 61 on a lower surface (lower surfaces of the tube portion 61 and the second flange portion 63) 60*a* of the upper housing 60.

The second flange portion 63 is fastened to the head plate 10 with the housing attaching bolts B3, and thus the upper housing 60 is attached to an upper surface 10*a* of the head plate 10. In this case, the tube portion 61 accommodates the protruding upper portion, and a cylindrical-shaped space exists between the tube portion 61 and the protruding upper portion.

The third sealing member 70 is an O-ring made of fluororesin, for example. The third sealing member 70 is disposed in the seal groove 65 of the upper housing 60. The third sealing member 70 liquid-tightly seals between the upper surface 10*a* of the head plate 10 and the lower surface 60*a* (the seal groove 65) of the upper housing 60. The sealability of the third sealing member 70 is determined by the tightening force of the housing attaching bolts B3. That is, the sealability is deteriorated when the housing attaching bolts B3 are loosened, and the sealability is improved when the housing attaching bolts B3 are tightened.

The shaft fixing member 80 fixes the lift shaft 20 to the lowered position when the lift shaft 20 is located in the lowered position. The shaft fixing member 80 includes the receiving member 81 and a fixing member 82.

The receiving member 81 has a ring plate shape. The outer diameter of the receiving member 81 is larger than the outer diameter of the first shaft portion 21 and the inner diameter of the color 7 and smaller than the inner diameter of the tube portion 61 and the outer diameter of the color 7. The receiving member 81 includes an insertion hole 81*a*.

The insertion hole 81*a* is a through hole that penetrates the receiving member 81 in the vertical direction. The insertion hole 81*a* is disposed at the center of the receiving member 81. The inner diameter of the insertion hole 81*a* is smaller than the outer diameter of the first shaft portion 21 and larger than the outer diameter of the external thread portion 23*b* of the first connecting member 23. The external thread portion 23*b* is disposed through the insertion hole 81*a*. The first nut member 25 and the connecting portion 23*a* of the first connecting member 23 are disposed above the receiving member 81. The first nut member 25 abutting on an upper surface 81*b* of the receiving member 81 is tightened, and thus the receiving member 81 is attached to the upper end surface 21*b* of the first shaft portion 21.

The fixing member 82 includes a peripheral wall portion 82*a* and a flange portion 82*b*.

The peripheral wall portion 82*a* has a cylindrical shape. The outer diameter of the peripheral wall portion 82*a* is smaller than the inner diameter of the tube portion 61. In the radial direction of the peripheral wall portion 82*a*, an upper end of the peripheral wall portion 82*a* protrudes outward and constitutes the ring plate-shaped flange portion 82*b*. That is, the peripheral wall portion 82*a* and the flange portion 82*b* are integrally formed. The peripheral wall portion 82*a* is disposed into the tube portion 61. When the fixing member 82 is not fastened to the upper housing 60 with the pressing bolts B5, the length of the portion of the peripheral wall portion 82*a* lower than the flange portion 82*b* is longer than the length between an upper end surface 60*b* of the upper housing 60 and the upper surface 81*b* of the receiving member 81 in the vertical direction. Thus, the flange portion 82*b* does not abut on the upper end surface 60*b* of the upper housing 60.

The flange portion 82*b* is fastened to the upper housing 60 with the pressing bolts B5, and thus the fixing member 82 is fastened to the upper housing 60. In this case, the flange portion 82*b* is pressed downward (toward the head plate 10 and the lift shaft 20) by the pressing bolts B5. A lower end portion of the peripheral wall portion 82*a* abuts on the upper surface 81*b* of the receiving member 81. As a result, the receiving member 81 and the fixing member 82 (i.e., shaft fixing member 80) presses the lift shaft 20 toward the head plate 10 side and fixes the lift shaft 20 to the lowered position. In this way, when the lift shaft 20 is located in the lowered position, the shaft fixing member 80 presses the lift shaft 20 toward the head plate 10 side and fixes the lift shaft 20 to the lowered position.

The sealing member 3 configured in this way is attached to the upper opening end 2*a* of the pump column 2 by fastening the head plate 10 to the upper opening end 2*a* with the plate attaching bolts B1. In this case, a gasket (not illustrated) is disposed between the upper opening end 2*a* and the head plate 10, thereby liquid-tightly sealing between the head plate 10 and the upper opening end 2*a*.

Sealing Structure by Using Sealing Member (1)

Next, sealing structure by using the sealing member 3 will be described with reference to FIG. 1 to FIG. 3. The sealing member 3 has the sealing structure that prevents the liquefied gas Lg and the vaporized liquefied gas Lg (hereinafter referred to as "vaporized gas Vg", see FIG. 4, the same applies below.) in the pump column 2 from leaking to the outside of the sealing member 3. The sealing structure includes the fitting portion 13, the bellows member 30, the first sealing member 40, and the second sealing member 50. The sealing structure is able to prevent the liquefied gas Lg and the vaporized gas Vg from leaking to the outside of the sealing member 3, regardless of whether the lift shaft 20 is located in the lowered position or in the raised position.

The sealing structure for each location of the lift shaft 20 will be described below in association with operations to the sealing member 3 (mainly the lift shaft 20).

When the pump 5 is in operation, the liquefied gas Lg discharged from the pump 5 rises in the pump column 2 and is supplied to the outside of the storage tank T from the liquid feeding path R1. The inside of the pump column 2 is filled with the liquefied gas Lg, and a discharge pressure from the pump 5 (e.g., maximum 2 MPa) is added to the head plate 10, the lift shaft 20, and the bellows member 30. In this case, the lift shaft 20 is pressed downward by the shaft fixing member 80. As a result, the lift shaft 20 is fixed to the lowered position.

When the lift shaft 20 is located in the lowered position, the bellows tube 31 is extended downward according to the position of the lower end surface 22*b* of the second shaft portion 22. In this case, an appropriate tension is applied to the bellows tube 31. Thus, the bellows tube 31 can resist the discharge pressure and does not deform excessively. As described above, since the bellows member 30 is integrally formed, the bellows member 30 does not have a gap that allows the liquefied gas Lg to leak due to the discharge pressure. Accordingly the leakage of the liquefied gas Lg from the bellows member 30 into the bellows internal space S is prevented.

When the lift shaft 20 is located in the lowered position, the liquefied gas Lg is blocked by the bellows member 30 and the first sealing member 40 and does not leak into the bellows internal space S. The second attaching member 33 is liquid-tightly fitted into the fitting portion 13, and thus the liquefied gas Lg does not leak into the insertion hole 11 from between the second attaching member 33 and the fitting portion 13. Even though the discharge pressure causes a small amount of liquefied gas Lg to leak into the insertion hole 11 from the space between the second attaching member 33 and the fitting portion 13, the liquefied gas Lg is blocked by the second sealing member 50 and does not leak into the upper housing 60.

When the lift shaft 20 is located in the lowered position, the lower end surface 21*c* of the first shaft portion 21 abuts on the second sealing member 50, and thus the downward movement of the lift shaft 20 lower than the lowered position is restricted. In this case, the first shaft portion 21 functions as the lowering restricting member in the present invention. As a result, the bellows tube 31 is not excessively extended, and technical problems such as breakage of the bellows member 30 (the bellows tube 31 or welding portion) do not occur.

Then, when the pump 5 is out of operation, the liquefied gas Lg remains in the pump column 2 to the same level as the liquid level of the liquefied gas in the storage tank T. A space above the liquid level in the pump column 2 is filled with the vaporized gas Vg. In this case, the discharge pressure from the pump 5 is not added to the head plate 10, the lift shaft 20, and the bellows member 30. Even in this state, due to the sealing structure described above, the vaporized gas Vg does not leak into the bellows internal space S and the insertion hole 11.

The pump 5 is taken out of the pump column 2 on a regular basis (e.g., every few years), and maintenance for the pump 5 is performed. When the pump 5 is taken out, closing the foot valve 6 and removing the residual gas (liquefied gas Lg and vaporized gas Vg) in the pump column 2 are required. As a previous preparation, the lift shaft 20 is raised from the lowered position to the raised position, and thus the pump 5 is raised to a predetermined height in the pump column 2.

As a previous preparation before the lift shaft 20 is raised, the lid portion 64 and the fixing member 82 are removed. As a result, the pressing by using the pressing bolts B5 is released, and the sealability of the second sealing member 50 is deteriorated. In this case, the bellows internal space S and the insertion hole 11 are still liquid-tightly sealed by the fitting portion 13, the bellows member 30, and the first sealing member 40. Thus, the residual gas does not leak from the bellows internal space S and the insertion hole 11 into the tube portion 61. In the present embodiment, the handling liquid is liquefied ammonia, and the vaporized gas Vg is ammonia gas that is flammable and highly toxic to a living body. Since the ammonia gas is lighter than the air, the ammonia gas is easily breathed in by a maintenance worker. Since the bellows member 30 is used in the sealing structure of the sealing member 3 according to the present invention, the sealing member 3 is applicable to a handling liquid that is difficult to handle such as liquefied ammonia.

Then, the cable (not illustrated) from the lift (not illustrated) is connected to the first connecting member 23 of the lift shaft 20, and the lift shaft 20 is raised to the raised position by the lift. In this case, the pump 5 is lifted by the lift shaft 20 via the support cable 4, and the foot valve 6 is closed by the biasing force of the spring (not illustrated).

Figure 4:
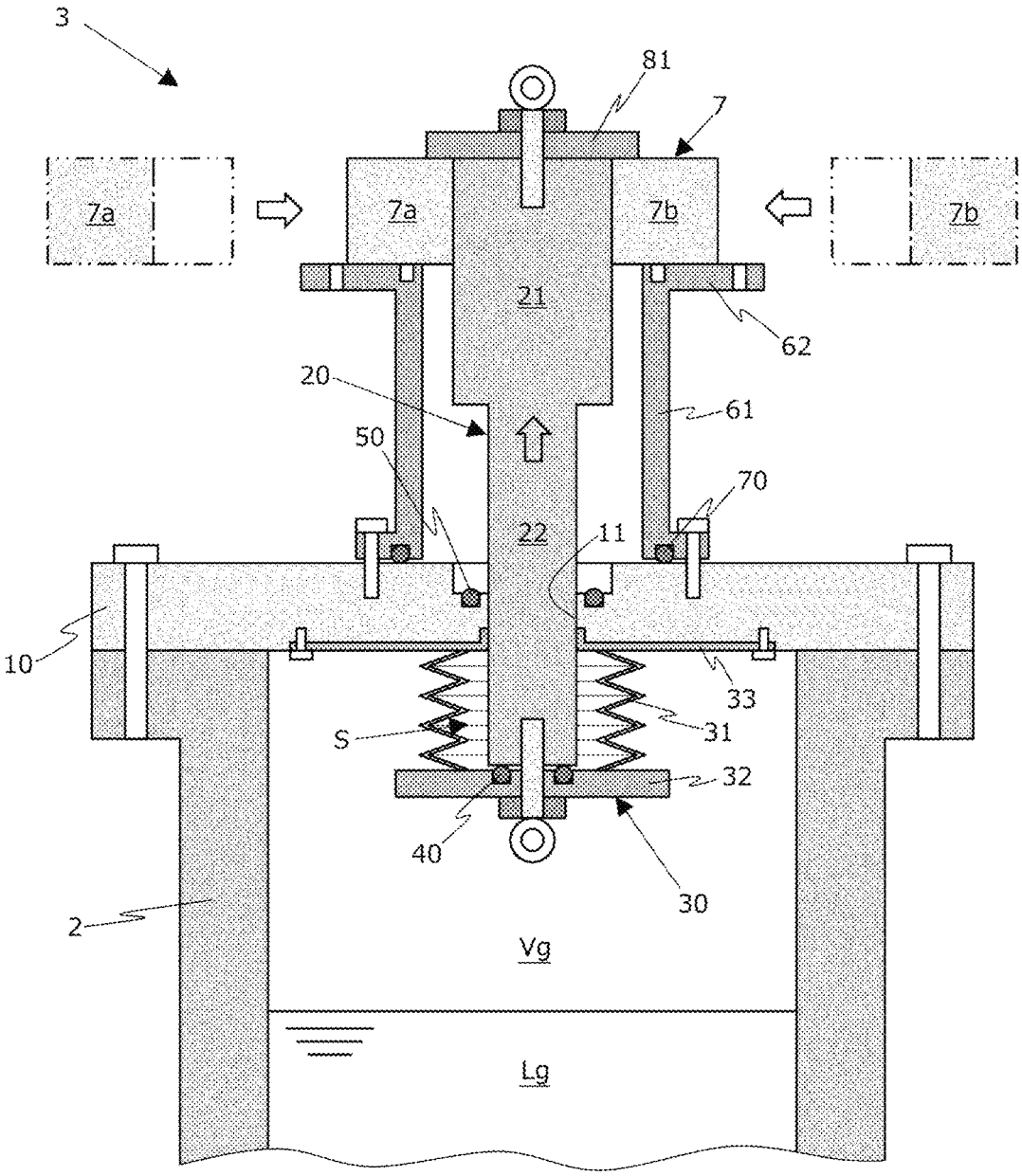
FIG. 4 is a schematic cross-sectional view of the sealing member when a lift shaft included in the sealing member in FIG. 2 is located in a raised position.

FIG. 4 is a schematic cross-sectional view of the sealing member 3 when the lift shaft 20 is located in the raised position.

When the lift shaft 20 is raised to the raised position, the sealing by using the second sealing member 50 is released and the bellows internal space S communicates with a space in the tube portion 61 via the insertion hole 11. In this case, the bellows tube 31 is contracted upward following the movement of the lift shaft 20. Thus, the sealing state of the bellows internal space S and the insertion hole 11 is maintained by the fitting portion 13, the bellows member 30, and the first sealing member 40. Thus, the residual gas does not leak from the bellows internal space S and the insertion hole 11 to the space in the tube portion 61 and to the outside of the sealing member 3.

When the lift shaft 20 is located in the raised position, the color 7 can be attached between the receiving member 81 and the first flange portion 62 of the upper housing 60. When the color 7 is attached between the receiving member 81 and the first flange portion 62, the lift shaft 20 is fixed to the raised position. In this case, the sealing member 3 suspends and supports the pump 5.

When the lift shaft 20 is raised above the raised position, the bellows tube 31 is contracted upward to the limit, and thus the upward movement of the lift shaft 20 upper than the raised position may be restricted. In this case, the bellows member 30 may function as a raising restricting member in the present invention.

Then, an inert gas is introduced into the pump column 2 and the residual gas in the pump column 2 is returned to the storage tank T. The subsequent process of removing the pump 5 is a known process, and the description thereof is omitted.

Conclusion (1)

According to the embodiment described above, the sealing member 3 includes the head plate 10, the lift shaft 20, and the bellows member 30. The head plate 10 includes the insertion hole 11 extending in the vertical direction and is attached to the upper opening end 2*a* of the pump column 2 so as to close the upper opening end 2*a*. The lift shaft 20 is disposed penetrating the insertion hole 11 and is raised and lowered between the raised position and the lowered position when the pump 5 is raised and lowered. The bellows member 30 extends and contracts in the axial direction (the vertical direction) of the lift shaft 20 corresponding to the raising and lowering of the lift shaft 20. The bellows member 30 includes the bellows tube 31, the first attaching member 32, and the second attaching member 33. The bellows tube 31 covers the outer peripheral surface of the protruding lower portion of the lift shaft 20. The first attaching member 32 is disposed contiguously to the lower end 31*a* of the bellows tube 31 and is attached to the lower end surface 22*b* of the second shaft portion 22 (the protruding lower portion). The second attaching member 33 is disposed contiguously to the upper end 31*b* of the bellows tube 31 and is attached to the lower surface 10*b* of the head plate 10. According to this configuration, the bellows internal space S is surrounded by the bellows member 30. Thus, even though the lift shaft 20 is raised and lowered, the bellows tube 31 extends and contracts corresponding to the raising and lowering of the lift shaft 20, and the bellows internal space S is sealed by the bellows member 30. In this way, in the sealing member 3, the leakage of the liquefied gas Lg and the residual gas in raising and lowering the pump 5 is prevented by the bellows member 30.

According to the embodiment described above, the insertion hole 11 includes the fitting portion 13 into which the second attaching member 33 is liquid-tightly fitted. This configuration enables liquid-tight sealing between the second attaching member 33 and the fitting portion 13 (the lower surface 10*b* of the head plate 10). As a result, the bellows internal space S and the insertion hole 11 are liquid-tightly sealed by the fitting portion 13 and the bellows member 30. Accordingly, in the sealing member 3, the leakage of the liquefied gas Lg and the residual gas in raising and lowering the pump 5 is prevented by the fitting portion 13 and the bellows member 30.

According to the embodiment described above, the sealing member 3 includes the first sealing member 40 disposed between the first attaching member 32 and the lift shaft 20. According to this configuration, the bellows internal space S is liquid-tightly sealed by the bellows member 30 and the first sealing member 40. Accordingly, in the sealing member 3, the leakage of the liquefied gas Lg and the residual gas in raising and lowering the pump 5 is prevented by the bellows member 30 and the first sealing member 40.

According to the embodiment described above, the lift shaft 20 includes the first shaft portion 21 and the second shaft portion 22. The second shaft portion 22 has the outer diameter smaller than the outer diameter of the first shaft portion 21 and is disposed below the first shaft portion 21 and through the second hole portion 11*b*. The second sealing member 50 is disposed between the lower end surface 21*c* of the first shaft portion 21 and the bottom surface 11*d* of the first hole portion 11*a* (the head plate 10). According to this configuration, the first shaft portion 21 cannot be inserted through the second hole portion 11*b*, and the downward movement of the lift shaft 20 lower than the lowered position is restricted. That is, the first shaft portion 21 functions as the lowering restricting member in the present invention. When the lift shaft 20 is lowered to the lowered position, an operator cannot see the state of the bellows member 30. Thus, without restriction on the lowering of the lift shaft 20, the bellows tube 31 is excessively extended, and technical problems such as breakage of the bellows member 30 may occur. In contrast, according to this configuration, the bellows tube 31 is not excessively extended, and technical problems such as breakage of the bellows member 30 do not occur. When the lift shaft 20 is located in the lowered position, the gap between the lower end surface 21*c* of the first shaft portion 21 and the bottom surface lid of the first hole portion 11*a* is sealed by the second sealing member 50.

According to the embodiment described above, the sealing member 3 includes the shaft fixing member 80 that fixes the lift shaft 20 to the lowered position. The shaft fixing member 80 presses the lift shaft 20 toward the head plate 10 side by the pressing bolts B5. According to this configuration, even though the discharge pressure is added to the lift shaft 20, the lift shaft 20 is fixed to the lowered position. Since the second sealing member 50 is pressed between the lower end surface 21*c* of the first shaft portion 21 and the bottom surface 11*d* of the first hole portion 11*a*, the sealability of the second sealing member 50 is improved.

According to the embodiment described above, the sealing member 3 includes the upper housing 60 attached to the upper surface 10*a* of the head plate 10 and the third sealing member 70 disposed between the upper housing 60 and the upper surface 10*a*. The upper housing 60 accommodates the protruding upper portion when the lift shaft 20 is located in the lowered position. According to this configuration, when the pump 5 is in operation, the protruding upper portion is protected without being exposed to wind and rain. Even though a small amount of liquefied gas Lg leaks into the upper housing 60, the upper housing 60 and the third sealing member 70 do not allow the liquefied gas Lg to leak to the outside of the sealing member 3.

According to the embodiment described above, the bellows member 30 functions as the raising restricting member that restricts the upward movement of the lift shaft 20 upper than the raised position. According to this configuration, technical problems such as coming-off of the lift shaft 20 do not occur.

Submerged Pump System (2)

Next, another embodiment (hereinafter referred to as a "second embodiment") of the submerged pump system according to the present invention will be described with a focus on differences from the first embodiment described above. The second embodiment is different from the first embodiment in that the sealing member includes a lower housing and the bellows member includes the raising restricting member. In the following description, elements in common with the first embodiment are indicated with the same reference signs, FIG. 1 to FIG. 3 will be referred to as necessary and the description thereof will be omitted.

Configuration of Submerged Pump System (2)

Figure 5:
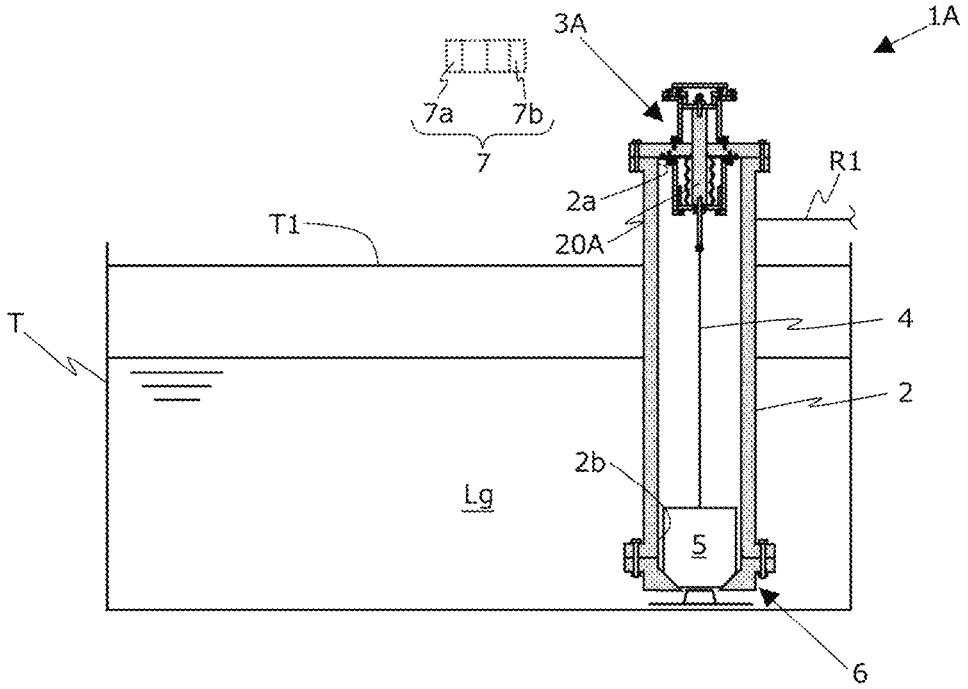
FIG. 5 is a schematic cross-sectional view of the submerged pump system illustrating a second embodiment of the submerged pump system according to the present invention.

FIG. 5 is a schematic cross-sectional view of the submerged pump system illustrating the second embodiment of the submerged pump system according to the present invention.

A submerged pump system 1A is attached to the storage tank T in which the liquefied gas Lg is stored and feeds the liquefied gas Lg from the storage tank T to the outside. The submerged pump system 1A includes the pump column 2, a sealing member 3A, the support cable 4, the pump 5, the foot valve 6, and the color 7.

Configuration of Sealing Member (2)

Next, a specific configuration of the sealing member 3A (sealing member according to the present invention) will be described.

Figure 6:
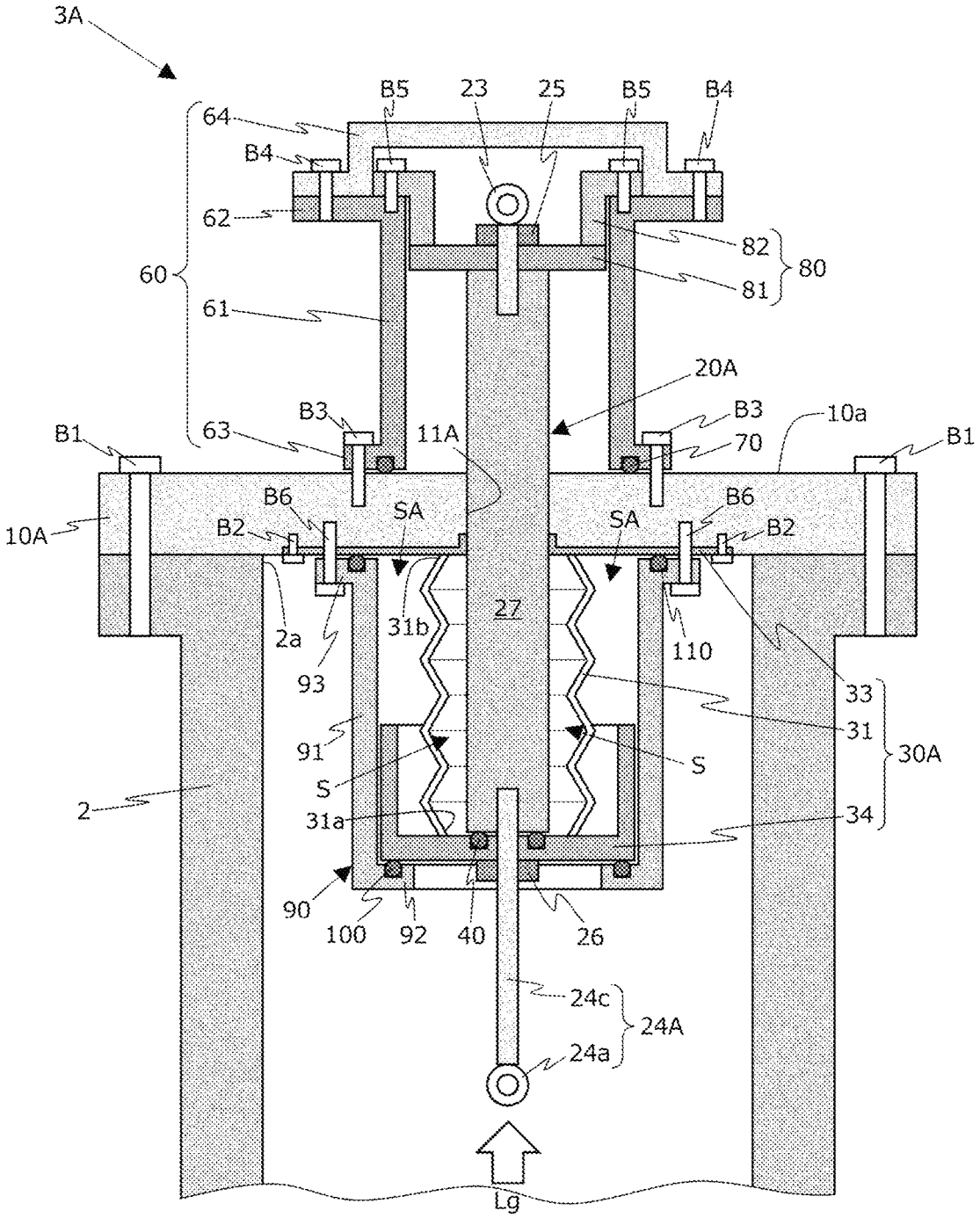
FIG. 6 is a schematic cross-sectional view of the sealing member in the second embodiment.

FIG. 6 is a schematic cross-sectional view of the sealing member 3A in the second embodiment.

Figure 7:
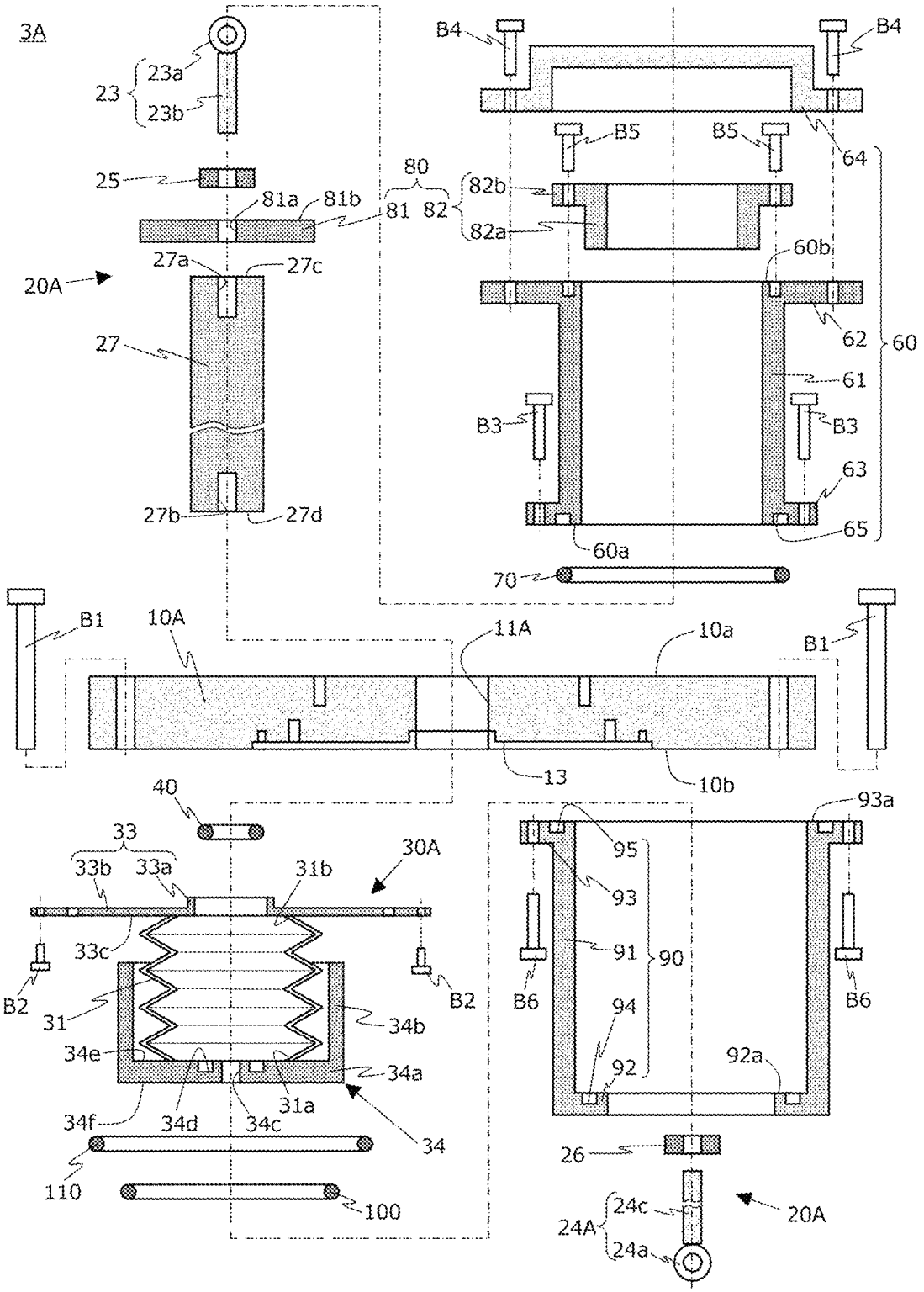
FIG. 7 is a schematic exploded cross-sectional view of the sealing member in FIG. 6.

FIG. 7 is a schematic exploded cross-sectional view of the sealing member 3A.

FIG. 6 illustrates the sealing member 3A when a lift shaft 20A described later is located in the lowered position. FIG. 6 also illustrates the upper portion of the pump column 2 for convenience of description. In the following description, the bolt holes corresponding to bolts B1 to B6 described later are a well-known technique, and the description thereof will be omitted. In the following description, FIG. 5 will be referred to as necessary.

The sealing member 3A includes a head plate 10A, the lift shaft 20A, a bellows member 30A, the first sealing member 40, the upper housing 60, the third sealing member 70, the shaft fixing member 80, the lower housing 90, a fourth sealing member 100, a fifth sealing member 110, the plurality of plate attaching bolts B1, the plurality of bellows attaching bolts B2, the plurality of housing attaching bolts B3, the plurality of lid attaching bolts B4, the plurality of pressing bolts B5, and a plurality of housing attaching bolts B6.

The functions of the head plate 10A, the lift shaft 20A, and the bellows member 30A are common to the functions of the head plate 10, the lift shaft 20, and the bellows member 30 in the first embodiment, respectively.

The head plate 10A has a disc shape, for example. The head plate 10A is made of metal such as stainless steel, for example. The head plate 10A includes an insertion hole 11A and the fitting portion 13.

The insertion hole 11A is a through hole that penetrates the head plate 10A in the vertical direction. That is, the insertion hole 11A extends in the vertical direction in the head plate 10A. The insertion hole 11A is disposed at the center of the head plate 10A. The inner diameter of the insertion hole 11A is slightly larger than an outer diameter of a shaft body 27 described later. The insertion hole 11A is an example of the through hole in the present invention.

The lift shaft 20A includes the first connecting member 23, a second connecting member 24A, the first nut member 25, the second nut member 26, and the shaft body 27.

The second connecting member 24A is a member to which the support cable 4 is connected. The second connecting member 24A includes the ring-shaped connecting portion 24*a* and an external thread portion 24*c* extending upward from the connecting portion 24*a*. The length of the external thread portion 24*c* is longer than the length of the external thread portion 24*b* in the first embodiment. The second connecting member 24A is attached to a lower end of the shaft body 27 by screwing the external thread portion 24*c* into a second internal thread hole 27*b* described later.

The shaft body 27 guides the raising and lowering of the lift shaft 20A together with the insertion hole 11A and the tube portion 31 of the head plate 10A. The shaft body 27 has a columnar shape long in the vertical direction. The shaft body 27 includes a first internal thread hole 27*a* and a second internal thread hole 27*b*.

The first internal thread hole 27*a* opens on an upper end surface 27*c* of the shaft body 27 along the vertical direction. The second internal thread hole 27*b* opens on a lower end surface 27*d* of the shaft body 27 along the vertical direction.

The lift shaft 20A is disposed through the insertion hole 11A of the head plate 10A from above and is disposed penetrating the insertion hole 11A. The lift shaft 20A can be raised and lowered between the lowered position and the raised position when the pump 5 is raised and lowered. When the lift shaft 20A is located in the raised position and the lowered position, the shaft body 27 protrudes upward and downward from the head plate 10A.

The bellows member 30A includes the bellows tube 31, the second attaching member 33, and a first attaching member 34.

The first attaching member 34 attaches the bellows tube 31 to the lift shaft 20A (the protruding lower portion described later). The first attaching member 34 includes a bottom portion 34*a*, a wall portion 34*b*, an insertion hole 34*c*, and a seal groove 34*d*.

The bottom portion 34*a* has a ring plate shape. The bottom portion 34*a* is disposed below and adjacent to a lower end 31*a* of the bellows tube 31. The outer edge portion of the bottom portion 34*a* extends upward and constitutes the cylindrical-shaped wall portion 34*b*. That is, the bottom portion 34*a* and the wall portion 34*b* are integrally formed. In the vertical direction, the length of the wall portion 34*b* is longer than the length of the fully contracted bellows tube 31. The inner diameter of the wall portion 34*b* is larger than the outer diameter of the bellows tube 31. The outer diameter of the wall portion 34*b* is smaller than the inner diameter of a tube portion 91 described later.

The insertion hole 34*c* is a through hole that penetrates the bottom portion 34*a* in the vertical direction. The insertion hole 34*c* is disposed at the center of the bottom portion 34*a*. The inner diameter of the insertion hole 34*c* is larger than the outer diameter of the external thread portion 24*b* of the second connecting member 24A and smaller than the outer diameter of the shaft body 27.

The seal groove 34*d* is a ring-shaped groove in which the first sealing member 40 is disposed. The seal groove 34*d* is disposed concentrically with the insertion bole 34*c* on an upper surface 34*e* of the bottom portion 34*a*.

The lower end 31*a* of the bellows tube 31 is liquid-tightly welded to the upper surface 34*e* of the bottom portion 34*a* of the first attaching member 34 over the entire circumference of the bellows tube 31 in the circumferential direction. The upper end 31*b* of the bellows tube 31 is liquid-tightly welded to the lower surface 33*c* of the second attaching member 33 over the entire circumference of the bellows tube 31 in the circumferential direction. As a result, the bellows tube 31, the second attaching member 33, and the first attaching member 34 are integrally formed. In the radial direction of the bottom portion 34*a*, the seal groove 34*d* is disposed inward of the lower end 31*a* of the bellows tube 31. The wall portion 34*b* covers the outer peripheral surface of the lower portion of the bellows tube 31.

The second attaching member 33 is liquid-tightly fitted into the fitting portion 13, and thus the bellows tube 31 is attached to the lower surface 10*b* of the head plate 101. The second attaching member 33 is pressed toward the head plate 10A by the bellows attaching bolts B2. The bellows tube 31 accommodates a protruding lower portion of the lift shaft 20A and covers an outer peripheral surface thereof. The protruding lower portion is a lower half portion of the shaft body 27, and the length thereof varies depending on the raising and lowering of the lift shaft 20A. The bellows internal space S exists between the bellows tube 31 and the lift shaft 20A (the shaft body 27).

The external thread portion 24*c* of the second connecting member 24A is disposed through the insertion hole 34*c*. The second nut member 26 and the connecting portion 24*a* of the second connecting member 24A is disposed below the bottom portion 34*a*. The second nut member 26 abutting on a lower surface 34*f* of the bottom portion 34*a* is tightened, and thus the first attaching member 34 is pressed upward (toward the shaft body 27) and is attached to the lower end surface 27*d* of the shaft body 27 (the protruding lower portion).

The first sealing member 40 is disposed in the seal groove 34*d* of the first attaching member 34.

The lower housing 90 covers the outer peripheral surface of the bellows tube 31 and the outer peripheral surface of the first attaching member 34 (each outer peripheral surface of the bottom portion 34*a* and the wall portion 34*b*). The lower housing 90 includes the tube portion 91, an inner flange portion 92, an outer flange portion 93, a first seal groove 94, and a second seal groove 95.

The tube portion 91 has a cylindrical shape. The inner diameter of the tube portion 91 is larger than the outer diameter of the bellows tube 31 and the outer diameter of the wall portion 34*b*. In the radial direction of the tube portion 91, the lower end portion of the tube portion 91 protrudes inward and constitutes the ring plate-shaped inner flange portion 92. The upper end portion of the tube portion 91 protrudes outward and constitutes the ring plate-shaped outer flange portion 93. That is, the tube portion 91, the inner flange portion 92, and the outer flange portion 93 are integrally formed.

The first seal groove 94 is a ring-shaped groove in which the fourth sealing member 100 is disposed. The first seal groove 94 is disposed concentrically with the tube portion 91 on an upper surface 92*a* of the inner flange portion 92.

The second seal groove 95 is a ring-shaped groove in which the fifth sealing member 110 is disposed. The second seal groove 95 is disposed concentrically with the tube portion 91 on an upper surface 93*a* of the outer flange portion 93.

The outer flange portion 93 is fastened to the second attaching member 33 and the head plate 10A with the housing attaching bolts B6, and thus the lower housing 90 is attached to the lower surface 33*c* of the second attaching member 33. In this case, the tube portion 91 covers the outer peripheral surfaces of the bellows tube 31 and the first attaching member 34. A cylindrical-shaped space SA exists between the bellows tube 31 and the tube portion 91. The upper surface 92*a* of the inner flange portion 92 faces the lower surface 34*f* of the first attaching member 34.

The fourth sealing member 100 is an O-ring made of fluororesin, for example. The fourth sealing member 100 is disposed in the first seal groove 94 of the lower housing 90. That is, the fourth sealing member 100 is disposed between the lower surface 34*f* of the bottom portion 34*a* of the first attaching member 34 and the upper surface 92*a* of the inner flange portion 92. When the lift shaft 20A is located in the lowered position, the fourth sealing member 100 abuts on the bottom surface 34*f* and the upper surface 92*a* and liquid-tightly seals therebetween. The sealability of the fourth sealing member 100 is determined by the tightening force of the pressing bolts B5. That is, the sealability is deteriorated when the pressing bolts B5 are loosened, and the sealability is improved when the pressing bolts B5 are tightened. The fourth sealing member 100 is an example of a lower sealing member in the present invention.

The fifth sealing member 110 is an O-ring made of fluororesin, for example. The fifth sealing member 110 is disposed in the second seal groove 95 of the lower housing 90. That is, the fifth sealing member 110 is disposed between the lower surface 33*c* of the second attaching member 33 and the upper surface 93*a* of the outer flange portion 93 and liquid-tightly seals therebetween. The sealability of the fifth sealing member 110 is determined by the tightening force of the housing attaching bolts B6. That is, the sealability is deteriorated when the housing attaching bolts B6 are loosened, and the sealability is improved when the housing attaching bolts B6 are tightened. The fifth sealing member 110 is an example of an upper sealing member in the present invention.

Sealing Structure by Using Sealing Member (2)

Next, sealing structure by using the sealing member 3A will be described with reference to FIG. 5 to FIG. 7. The sealing member 3A has the sealing structure that prevents the liquefied gas Lg and the vaporized gas Vg (see FIG. 4 and FIG. 8, the same applies below.) in the pump column 2 from leaking to the outside of the sealing member 3A. The sealing structure includes the fitting portion 13, the bellows member 30A, the first sealing member 40, the lower housing 90, the fourth sealing member 100, and the fifth sealing member 110. The sealing structure is able to prevent the liquefied gas Lg and the vaporized gas Vg from leaking to the outside of the sealing member 3A, regardless of whether the lift shaft 20A is located in the lowered position or in the raised position.

The sealing structure for each location of the lift shaft 20A will be described below in association with operations to the sealing member 3A (mainly the lift shaft 20A).

When the pump 5 is in operation, the discharge pressure from the pump 5 is added to the head plate 10A, the lift shaft 20A, the second attaching member 33, the first attaching member 34, and the lower housing 90. In this case, the lift shaft 20A is pressed downward by the shaft fixing member 80. As a result, the lift shaft 20A is fixed to the lowered position.

When the lift shaft 20A is located in the lowered position, the lower surface 34*f* of the bottom portion 34*a* abuts on the fourth sealing member 100, thereby liquid-tightly sealing between the lower surface 34*f* and the upper surface 92*a* of the inner flange portion 92. Accordingly, the space in the tube portion 91 is liquid-tightly sealed by the fourth sealing member 100 and the fifth sealing member 110. As a result, the discharge pressure is blocked by the lower housing 90 and is not propagated to the bellows tube 31. The bellows internal space S is doubly sealed by the lower housing 90 and the bellows member 30A.

When the lift shaft 20A is located in the lowered position, the liquefied gas Lg does not leak into the bellows internal space S and the insertion hole 11A, similarly to the first embodiment. Even though the discharge pressure causes a small amount of liquefied gas Lg to leak into the insertion hole 11A from between the second attaching member 33 and the fitting portion 13, the liquefied gas Lg is blocked by the third sealing member 70 and does not leak to the outside of the upper housing 60.

When the lift shaft 20A is located in the lowered position, the lower surface 34*f* of the bottom portion 34*a* abuts on the fourth sealing member 100, and thus the downward movement of the lift shaft 20A lower than the lowered position is restricted. In this case, the inner flange portion 92 functions as the lowering restricting member in the present invention. As a result, the bellows tube 31 is not excessively extended, and technical problems such as breakage of the bellows member 30A do not occur.

Then, when the pump 5 is out of operation, the discharge pressure from the pump 5 is not added to the head plate 10A, the lift shaft 20A, the second attaching member 33, the first attaching member 34, and the lower housing 90. Even in this state, due to the sealing structure described above, the vaporized gas Vg does not leak into the bellows internal space S and the insertion hole 11A.

As a previous preparation before the lift shaft 20A is raised, the lid portion 64 and the fixing member 82 are removed. As a result, the pressing by using the pressing bolts B5 is released, and the sealability of the fourth sealing member 100 is deteriorated. In this case, the residual gas may leak into the space in the tube portion 91. However, the bellows internal space S and the insertion hole 11A are still liquid-tightly sealed by the fitting portion 13, the bellows member 30A, and the first sealing member 40. Thus, the residual gas does not leak from the bellows internal space S and the insertion hole 11A into the space in the tube portion 61. Since the bellows member 30A is used in the sealing structure of the sealing member 3A according to the present invention, the sealing member 3A is applicable to a handling liquid that is difficult to handle such as liquefied ammonia.

Figure 8:
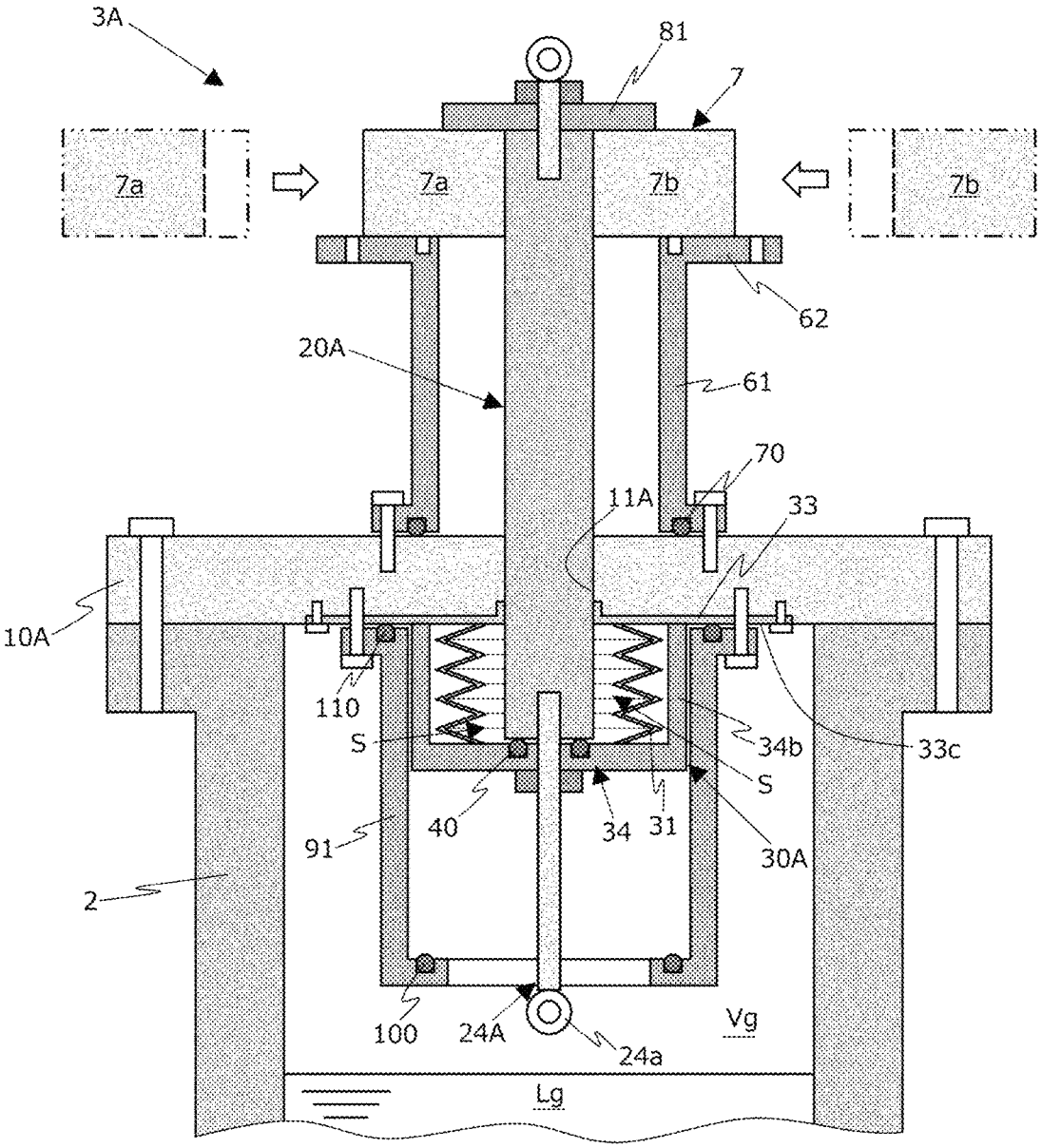
FIG. 8 is a schematic cross-sectional view of the sealing member when the lift shaft included in the sealing member in FIG. 6 is located in the raised position.

FIG. 8 is a schematic cross-sectional view of the sealing member 3A when the lift shaft 20A is located in the raised position.

When the lift shaft 20A is raised to the raised position, the sealing by using the fourth sealing member 100 is released, and the residual gas flows into the space in the tube portion 91. In this case, the bellows tube 31 is contracted upward following the movement of the lift shaft 20A. Thus, the sealing state of the bellows internal space S and the insertion hole 11A is maintained by the bellows member 30A and the first sealing member 40. Accordingly, the residual gas does not leak from the bellows internal space S and the insertion hole 11A to the space in the tube portion 61 and to the outside of the sealing member 3A.

When the lift shaft 20A is raised to the raised position, the wall portion 34*b* of the first attaching member 34 abuts on the lower surface 33*c* of the second attaching member 33, and thus the upward movement of the lift shaft 20A upper than the raised position is restricted. In this case, the wall portion 34*b* functions as the raising restricting member in the present invention. As a result, the bellows tube 31 is not excessively contracted, and technical problems such as breakage of the bellows member 30A and coming-off of the lift shaft 20A do not occur.

When the lift shaft 20A is located in the raised position, the connecting portion 24*a* of the second connecting member 24A is located below the inner flange portion 92 in the vertical direction. Accordingly, the support cable 4 connected to the connecting portion 24*a* does not interfere with the lower housing 90.

Conclusion (2)

According to the embodiment described above, the sealing member 3A includes the head plate 10A, the lift shaft 20A, and the bellows member 30A. The head plate 10A includes the insertion hole 11A extending in the vertical direction and is attached to the upper opening end 2*a* of the pump column 2 so as to close the upper opening end 2*a*. The lift shaft 20A is disposed penetrating the insertion hole 11A and is raised and lowered between the raised position and the lowered position when the pump 5 is raised and lowered. The bellows member 30A extends and contracts in the axial direction (the vertical direction) of the lift shaft 20A corresponding to the raising and lowering of the lift shaft 20A. The bellows member 30A includes the bellows tube 31, the first attaching member 34, and the second attaching member 33. The bellows tube 31 covers the outer peripheral surface of the protruding lower portion of the lift shaft 20A. The first attaching member 34 is disposed contiguously to the lower end 31*a* of the bellows tube 31 and is attached to the lower end surface 27*d* of the shaft body 27 (the protruding lower portion). The second attaching member 33 is disposed contiguously to the upper end 31*b* of the bellows tube 31 and is attached to the lower surface 10*b* of the head plate 10A. According to this configuration, the bellows internal space S is surrounded by the bellows member 30A. Thus, even though the lift shaft 20A is raised and lowered, the bellows tube 31 extends and contracts corresponding to the raising and lowering of the lift shaft 20A, and the bellows internal space S is sealed by the bellows member 30A. In this way in the sealing member 3A, the leakage of the liquefied gas Lg and the residual gas in raising and lowering the pump 5 is prevented by the bellows member 30A.

According to the embodiment described above, the insertion hole 11A includes the fitting portion 13 into which the second attaching member 33 is liquid-tightly fitted. This configuration enables liquid-tight sealing between the second attaching member 33 and the fitting portion 13 (the lower surface 10*b* of the head plate 10A). As a result, the bellows internal space S and the insertion hole 11A are liquid-tightly sealed by the fitting portion 13 and the bellows member 30A. Accordingly in the sealing member 3A, the leakage of the liquefied gas Lg and the residual gas in raising and lowering the pump 5 is prevented by the bellows member 30A.

According to the embodiment described above, the sealing member 3A includes the first sealing member 40 disposed between the first attaching member 34 and the lift shaft 20A. According to this configuration, the bellows internal space S is liquid-tightly sealed by the bellows member 30A and the first sealing member 40. Accordingly in the sealing member 3A, the leakage of the liquefied gas Lg and the residual gas in raising and lowering the pump 5 is prevented by the bellows member 30A and the first sealing member 40.

According to the embodiment described above, the sealing member 3A includes the lower housing 90. The lower housing 90 includes the tube portion 91 covering the outer peripheral surface of the bellows tube 31 and the inner flange portion 92 facing the lower surface 34*f* of the first attaching member 34. According to this configuration, the downward movement of the lift shaft 20A lower than the lowered position is restricted. That is, the inner flange portion 92 functions as the lowering restricting member in the present invention. As a result, the bellows tube 31 is not excessively extended, and technical problems such as breakage of the bellows member 30A do not occur. According to this configuration, the bellows tube 31 is covered with the lower housing 90. Thus, the bellows tube 31 is not exposed to the flow of the liquefied gas Lg, and influence of the discharge pressure is eliminated.

According to the embodiment described above, the sealing member 3A includes the fourth sealing member 100 and the fifth sealing member 110. When the lift shaft 20A is located in the lowered position, the fourth sealing member 100 is disposed between the lower surface 34*f* and the upper surface 92*a* of the inner flange portion 92 and abuts on the lower surface 34*f* and the upper surface 92*a*. The fifth sealing member 110 is disposed between the second attaching member 33 and the lower housing 90. According to this configuration, the space in the tube portion 91 is liquid-tightly sealed by the fourth sealing member 100 and the fifth sealing member 110. As a result, the discharge pressure is blocked by the lower housing 90, the fourth sealing member 100, and the fifth sealing member 110 and is not propagated to the bellows tube 31. The bellows internal space S is doubly sealed by the lower housing 90 and the bellows member 30A.

According to the embodiment described above, the sealing member 3A includes the shaft fixing member 80 that fixes the lift shaft 20A to the lowered position. According to this configuration, even though the discharge pressure is added to the lift shaft 20A, the lift shaft 20A is fixed to the lowered position. Since the fourth sealing member 100 is pressed between the lower surface 34*f* and the upper surface 92*a*, the sealability of the fourth sealing member 100 is improved.

According to the embodiment described above, the first attaching member 34 includes the ring plate-shaped bottom portion 34*a* adjacent to the lower end 31*a* of the bellows tube 31 and the wall portion 34*b* extending upward from the outer edge portion of the bottom portion 34*a*. According to this configuration, the first attaching member 34 functions as the raising restricting member that restricts the upward movement of the lift shaft 20A upper than the raised position. As a result, the bellows tube 31 is not excessively contracted, and technical problems such as breakage of the bellows member 30A (the bellows tube 31 or welding portion) do not occur. Technical problems such as coming-off of the lift shaft 20A do not occur, either.

According to the embodiment described above, the sealing member 3A includes the upper housing 60 attached to the upper surface 10*a* of the head plate 10A, and the third sealing member 70 disposed between the upper housing 60 and the upper surface 10*a*. The upper housing 60 accommodates the protruding upper portion when the lift shaft 20A is located in the lowered position. According to this configuration, when the pump 5 is in operation, the protruding upper portion is protected without being exposed to wind and rain. Even though a small amount of liquefied gas Lg leaks into the upper housing 60, the upper housing 60 and the third sealing member 70 do not allow the liquefied gas Lg to leak to the outside of the sealing member 3A.

Other Embodiments

Note that, in the first embodiment described above, the insertion hole 11 need not include the first hole portion 11*a*. In this case, for example, the seal groove 12 into which the second sealing member 50 is fitted may be disposed on the upper surface 10*a* of the head plate 10.

In the embodiments described above, the insertion hole 11, 11A and the tube portion 33*a* may include a ventilation groove that bypasses the bellows internal space S and the space in the tube portion 61. This configuration facilitates the inflow of the air into the bellows internal space S and the outflow of the air from the bellows internal space S. As a result, the bellows tube 31 easily extends and contracts.

In the first embodiment described above, the seal groove 12 may be disposed on the lower end surface 21*c* of the first shaft portion 21.

In the present invention, the lift shaft 20, 20A may be fixed by the color 7 not in the raised position but in a holding position located below the raised position. In this case, the lift shaft 20, 20A is raised to the raised position, the color 7 is disposed, and then the lift shaft 20, 20A is lowered to the holding position. According to this configuration, the color 7 can be easily disposed.

In the second embodiment described above, the shaft body 27 may be formed of the first shaft portion 21 and the second shaft portion 22. In this case, for example, the first shaft portion 21 may constitute a part of the protruding lower portion, and the first attaching member 34 may be attached to the lower end surface 21*c* of the first shaft portion 21. In this case, for example, the sealing member 3A may include a cylindrical-shaped color member covering the outer peripheral surface of the second shaft portion 22 and disposed between the first attaching member 34 and the second nut member 26, and the first attaching member 34 may be pressed upward via the color member.

In the first embodiment described above, the bellows member 30 may include the first attaching member 34 instead of the first attaching member 32. In this configuration, the bellows tube 31 is not excessively contracted, and technical problems such as breakage of the bellows member 30 (the bellows tube 31 or welding portion) do not occur. Technical problems such as coming-off of the lift shaft 20 do not occur, either.

In the second embodiment described above, the bellows member 30A may include the first attaching member 32 instead of the first attaching member 34.

In the embodiments described above, the bellows tube 31 may be integrally formed with the first attaching member 32, 34 and/or the second attaching member 33. According to this configuration, the strength of the bellows member 30, 30A is improved.

In the embodiments described above, the configuration for attaching the first attaching member 32, 34 and the lift shaft 20, 20A is not limited to the configurations in the present embodiments. That is, for example, the first attaching member 32, 34 may be liquid-tightly attached to the lift shaft 20, 20A by welding. For example, the first attaching member 32 may be liquid-tightly welded to the outer peripheral surface of the second shaft portion 22, and the first attaching member 34 may be liquid-tightly welded to the outer peripheral surface of the shaft body 27. In this case, the second nut member 26 is not required.

In the embodiments described above, the seal groove 32*b* may be disposed on the lower end surface 22*b* of the second shaft portion 22, and the seal groove 34*d* may be disposed on the lower end surface 27*d* of the shaft body 27.

In the embodiments described above, the configuration for sealing between the second attaching member 33 and the head plate 10, 10A is not limited to the configurations in the present embodiments. That is, for example, the second attaching member 33 may be liquid-tightly attached to the head plate 10, 10A by welding. For example, the second attaching member 33 may be disposed on the fitting portion 13 and attached to the head plate 10, 10A by the bellows attaching bolts B2. In this case, a sealing member is disposed between the lower surface 10*b* (the fitting portion 13) of the head plate 10, 10A and the second attaching member 33.

In the embodiments described above, the second attaching member 33 may have a ring plate shape. In this case, for example, the second hole portion 11*b* or the insertion hole 11A may have the function similar to that of the tube portion 33*a*.

In the second embodiment described above, the shape of the wall portion 34*b* is not limited to the cylindrical shape. That is, for example, the wall portion 34*b* may include a plurality of members with a circular arc plate shape (or plate shape, rod shape, etc.) disposed apart from each other.

In the second embodiment described above, the bottom portion 34*a* may include a plurality of through holes that penetrate the bottom portion 34*a* in the vertical direction between the lower end 31*a* of the bellows tube 31 and the wall portion 34*b*.

Figure 9A:
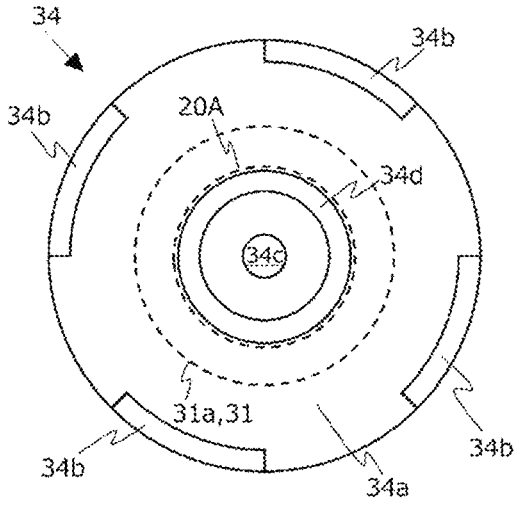
FIG. 9A is a schematic plan view of a first attaching member included in the sealing member in FIG. 6*a* illustrating a first modification example of the first attaching member.
Figure 9B:
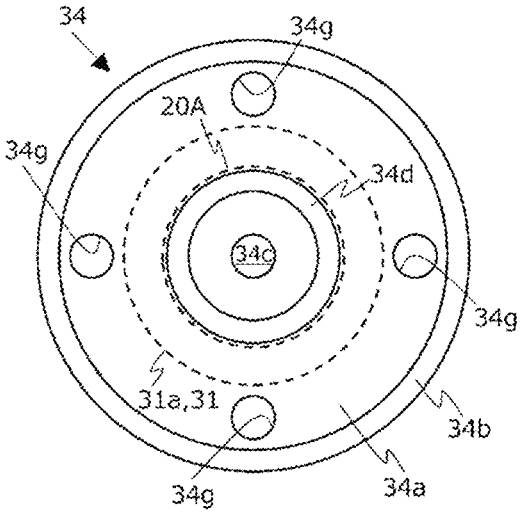
FIG. 9B is a schematic plan view of the first attaching member illustrating a second modification example of the first attaching member.

FIG. 9A is a schematic plan view of a first attaching member 34 illustrating a first modification example of the first attaching member 34 in the second embodiment, and FIG. 9B is a schematic plan view of the first attaching member 34 illustrating a second modification example of the first attaching member 34 in the second embodiment.

The figures illustrate the first attaching member 34 when viewed from the top. For convenience of description, the figures also illustrate the lift shaft 20A and the lower end portion 31*a* of the bellows tube 31 with dashed lines. As illustrated in FIG. 9A, the first attaching member 34 in the first modification example includes the wall portion 34*b* formed of four members with a circular arc plate shape. In the circumferential direction of the bottom portion 34*a*, each member forming the wall portion 34*b* is disposed at equal intervals on the outer edge of the bottom portion 34*a*. In this configuration, when the lift shaft 20A is raised, the liquefied gas Lg in the space surrounded by the wall portion 34*b* is removed downward from the gaps between each member.

As illustrated in FIG. 9B, the first attaching member 34 in the second modification example includes four through holes 34*g* disposed on the bottom portion 34*a* and penetrating the bottom portion 34*a* in the vertical direction. In the circumferential direction of the bottom portion 34*a*, the through holes 34*g* are disposed at equal intervals between the lower end 31*a* of the bellows tube 31 and the wall portion 34*b*. In this configuration, when the lift shaft 20A is raised, the liquefied gas Lg in the space surrounded by the wall portion 34*b* is removed downward from the through holes 34*g*. Note that the number of the members with a circular arc plate shape and the through holes 34*g* is not limited to "4".

In the embodiments described above, a sealing member such as a gasket may be disposed between the second attaching member 33 and the head plate 10, 10A. According to this configuration, the sealability between the second attaching member 33 and the head plate 10, 10A is improved.

In the embodiments described above, the material of the bellows member 30, 30A and the first to fifth sealing members 40, 50, 70, 100, and 110 may be appropriately selected according to a handling liquid and is not limited to the materials in the present embodiments.

In the embodiments described above, the first to fifth sealing members 40, 50, 70, 100, and 110 are not limited to O-ring. That is, for example, the first to fifth sealing members 40, 50, 70, 100, and 110 may be a ring plate-shaped gasket. In this case, each seal groove 12, 32*b*, 34*d*, 65, 94, and 95 is not required.

In the embodiments described above, an internal thread portion may be formed on the upper portion of the inner peripheral surface of the tube portion 61 of the upper housing 60, and an external thread portion corresponding to the internal thread portion may be formed on the outer peripheral surface of the peripheral wall portion 82*a* of the shaft fixing member 80. According to this configuration, the shaft fixing member 80 is screwed into the tube portion 61, and thus the shaft fixing member 80 can press the lift shaft 20, 20A downward.

In the first embodiment described above, the sealing member 3 need not include the second sealing member 50. In this configuration, the sealability in the insertion hole 11 is deteriorated, but the leakage of the liquefied gas Lg into the bellows internal space S and the insertion hole 11 is prevented by the fitting portion 13, the bellows member 30, and the first sealing member 40. Thus, the liquefied gas Lg does not leak to the outside of the sealing member 3. Also in this configuration, the first shaft portion 21 functions as the lowering restricting member.

In the embodiments described above, the sealing member 3, 3A need not include the raising restricting member and/or the lowering restricting member. In this case, for example, the height of the raised position and/or the lowered position may be set in advance.

In the embodiments described above, the configuration of the lowering restricting member is not limited to the first shaft portion 21 and the inner flange portion 92. That is, for example, the lowering restricting member may include a knock pin or a bolt fitted into the protruding upper portion. For example, the lowering (raising) restricting member may include a slide rail with a stopper disposed between the first attaching member 32, 34 and the second attaching member 33.

In the embodiments described above, the receiving member 81 may be integrally formed with the fixing member 82.

In the embodiments described above, when the flange portion 82*b* is fastened to the upper housing 60 by the pressing bolts B5, the flange portion 82*b* may or need not abut on the upper end surface 60*b* of the upper housing 60. In the former case, the force with which the fixing member 82 presses the receiving member 81 (pressing force) is uniform in the circumferential direction of the fixing member 82. Even though the fixing member 82 is attached and detached a plurality of times, the pressing force for each attachment is substantially the same. In contrast, in the latter case, the pressing force can be adjusted according to the state of the second sealing member 50 or the fourth sealing member 100, for example.

In the embodiments described above, the lower housing 90 may be attached to the lower surface 10*b* of the head plate 10, 10A. In this case, the fifth sealing member 110 is disposed between the lower surface 10*b* and the upper surface 93*a* of the outer flange portion 93.

In the embodiments described above, the sealing member 3, 3A need not include the bellows attaching bolts B2.

In the embodiments described above, the sealing member 3, 3A may include a gland seal disposed between the lift shaft 20, 20A and the upper housing 60 (the tube portion 61).

Aspects of the Present Invention

Next, aspects of the present invention conceived from the embodiments described above will be described below with reference to the terms and reference signs described in the embodiments.

A first aspect of the present invention is a sealing member (e.g., the sealing member 3, 3A) for sealing an opening end (e.g., the upper opening end 2*a*) of a cylindrical pump column (e.g., the pump column 2) configured to accommodate a pump (e.g., the pump 5) configured to be submerged in a handling liquid (e.g., the liquefied gas Lg) and for suspending and supporting the pump when the pump is raised and lowered in the pump column, the sealing member including: a head plate (e.g., the head plate 10, 10A) having a through hole (e.g., the insertion hole 11, 11A) extending in a vertical direction and attached to the opening end so as to close the opening end; a lift shaft (e.g., the lift shaft 20, 20A) disposed through the through hole and that is raised and lowered between a raised position and a lowered position when the pump is raised and lowered; and a bellows member (e.g., the bellows member 30, 30A) that extends and contracts in an axial direction of the lift shaft corresponding to the raising and lowering of the lift shaft, in which the bellows member includes: a bellows tube (e.g., the bellows tube 31) covering an outer peripheral surface of a protruding lower portion of the lift shaft protruding downward from the head plate; a first attaching member (e.g., the first attaching member 32, 34) disposed contiguously to a lower end (e.g., the lower end 31*a*) of the bellows tube and attached to the protruding lower portion (e.g., the second shaft portion 22, the shaft body 27) of the lift shaft; and a second attaching member (e.g., the second attaching member 33) disposed contiguously to an upper end (e.g., the upper end 31*b*) of the bellows tube and attached to a lower surface (e.g., the lower surface 10*b*) of the head plate.

According to this configuration, even though the lift shaft is raised and lowered, the bellows tube extends and contracts corresponding to the raising and lowering of the lift shaft, and the bellows internal space can be sealed by the bellows member. As a result, the leakage of the residual gas in raising and lowering the pump can be prevented by the bellows member. That is, the sealability of the sealing member is improved.

A second aspect of the present invention is the sealing member in the first aspect, in which the through hole includes a fitting portion (e.g., the fitting portion 13) into which second attaching member is fitted.

According to this configuration, the bellows internal space and the insertion hole are liquid-tightly sealed by the bellows member.

A third aspect of the present invention is the sealing member in the first or second aspect, further including a bellows sealing member (e.g., the first sealing member 40) disposed between the first attaching member and the protruding lower portion of the lift shaft.

According to this configuration, the leakage of the liquefied gas and the residual gas in raising and lowering the pump can be prevented by the bellows member and the first sealing member.

A fourth aspect of the present invention is the sealing member (e.g., the sealing member 3A) in any one of the first to third aspects, further including a lower housing (e.g., the lower housing 90) having an inner flange portion (e.g., the inner flange portion 92) facing a lower surface (e.g., the lower surface 34*f*) of the first attaching member and covering an outer peripheral surface of the bellows tube and an outer peripheral surface of the first attaching member, the lower housing attached to the lower surface (e.g., the lower surface 10*b*) of the head plate (e.g., the head plate 10A) or a lower surface (e.g., the lower surface 33*c*) of the second attaching member.

According to this configuration, the bellows tube is not excessively extended, and technical problems such as breakage of the bellows member do not occur. The bellows tube is not exposed to the flow of the liquefied gas.

A fifth aspect of the present invention is the sealing member in the fourth aspect, further including a lower sealing member (e.g., the fourth sealing member 100) disposed between the lower surface of the first attaching member and an upper surface (e.g., the upper surface 92*a*) of the inner flange portion and abutting, when the lift shaft is located in the lowered position, on the lower surface of the first attaching member and the upper surface of the inner flange portion, and an upper sealing member (e.g., the fifth sealing member 110) disposed between the lower surface of the head plate or a lower surface of the second attaching member and the lower housing.

According to this configuration, the discharge pressure is not propagated to the bellows tube. The bellows internal space is doubly sealed by the lower housing and the bellows member.

A sixth aspect of the present invention is the sealing member (e.g., sealing member 3) in any one of the first to third aspects, in which the lift shaft (e.g., the lift shaft 20) includes: a first shaft portion (e.g., the first shaft portion 21); and a second shaft portion (e.g., the second shaft portion 22) having an outer diameter smaller than an outer diameter of the first shaft portion and disposed below the first shaft portion and through the through hole, the sealing member further including a shaft sealing member (e.g., the second sealing member 50) disposed between the head plate and the first shaft portion.

According to this configuration, the bellows tube is not excessively extended, and technical problems such as breakage of the bellows member do not occur.

A seventh aspect of the present invention is the sealing member in the fifth or sixth aspect, further including a shaft fixing member (e.g., the shaft fixing member 80) that fixes the lift shaft, to the lowered position by pressing the lift shaft toward the head plate side.

According to this configuration, even though the discharge pressure is added to the lift shaft, the lift shaft is fixed to the lowered position. The sealability of the second sealing member and the fourth sealing member is improved.

An eighth aspect of the present invention is the sealing member (e.g., the sealing member 3A) in any one of the first to seventh aspects, further including a raising restricting member (e.g., the wall portion 34*b*) that restricts an upward movement of the lift shaft upper than the raised position, in which the first attaching member (e.g., the first attaching member 34) includes; a ring plate-shaped bottom portion (e.g., the bottom portion 34*a*) adjacent to the lower end of the bellows tube; and a wall portion (e.g., the wall portion 34*b*) extending upward from an outer edge portion of the bottom portion.

According to this configuration, the bellows tube is not excessively contracted, and technical problems such as breakage of the bellows member do not occur. Technical problems such as coming-off of the lift shaft do not occur, either.

A ninth aspect of the present invention is a submerged pump system including: a pump configured to be submerged in a handling liquid; a cylindrical pump column configured to accommodate the pump; and the sealing member according to any one of the first to eighth aspects.

According to this configuration, the leakage of the residual gas in raising and lowering the pump can be prevented by the bellows member.

What is claimed is:

1. A sealing member for sealing an opening end of a cylindrical pump column configured to accommodate a pump configured to be submerged in a handling liquid and for suspending and supporting the pump when the pump is raised and lowered in the pump column, the sealing member comprising:

a head plate having a through hole extending in a vertical direction and attached to the opening end so as to close the opening end;

a lift shaft disposed through the through hole and raised and lowered between a raised position and a lowered position when the pump is raised and lowered;

a bellows member configured to extend and contract in an axial direction of the lift shaft corresponding to the raising and lowering of the lift shaft; and a bellows sealing member, wherein the bellows member includes:

a bellows tube covering an outer peripheral surface of a protruding lower portion of the lift shaft protruding downward from the head plate;

a first attaching member disposed contiguously to a lower end of the bellows tube and attached to the protruding lower portion of the lift shaft; and a second attaching member disposed contiguously to an upper end of the bellows tube and attached to a lower surface of the head plate, adjacent to the through hole, wherein the second attaching member comprises a structure that includes:

a tube portion having a cylindrical shape, and a plate-shaped flange portion that protrudes outwards from the tube portion in a radial direction of the tube portion, the tube portion extends above an upper surface of the plate-shaped flange portion and has an outer diameter and an inner diameter, the inner diameter corresponding to a diameter of the through hole, the head plate includes a fitting portion that comprises a cylindrically shaped recess adjacent the through hole and a plate-shaped recess adjacent the cylindrically shaped recess, configured such that the tube portion fits into the cylindrically shaped recess and the plate-shaped flange portion fits into the plate-shaped recess when the second attaching member is attached to the lower surface of the head plate, the bellows sealing member disposed between the first attaching member and the protruding lower portion of the lift shaft, the first attaching member disposed below the lift shaft, the bellows sealing member abuts on an upper surface of the first attaching member and a lower end surface of the lift shaft and liquid-tightly seals between the upper surface of the first attaching member and the lower end surface of the lift shaft, and the lower end surface is a horizontal surface.

2. The sealing member according to claim 1, further comprising a lower housing having an inner flange portion facing a lower surface of the first attaching member and covering an outer peripheral surface of the bellows tube and an outer peripheral surface of the first attaching member, the lower housing attached to the lower surface of the head plate or a lower surface of the second attaching member.

3. The sealing member according to claim 2, further comprising:

a lower sealing member disposed between the lower surface of the first attaching member and an upper surface of the inner flange portion and abutting, when the lift shaft is in the lowered position, on the lower surface of the first attaching member and the upper surface of the inner flange portion; and an upper sealing member disposed between the lower surface of the head plate or the lower surface of the second attaching member and the lower housing.

4. The sealing member according to claim 1, wherein the lift shaft includes:

a first shaft portion; and a second shaft portion having an outer diameter smaller than an outer diameter of the first shaft portion and disposed below the first shaft portion and through the through hole, the sealing member further comprising a shaft sealing member disposed between the head plate and the first shaft portion.

5. The sealing member according to claim 4, further comprising a shaft fixing member configured to fix the lift shaft to the lowered position by pressing the lift shaft toward the head plate side.

6. The sealing member according to claim 1, wherein the first attaching member includes:

a ring plate-shaped bottom portion adjacent to the lower end of the bellows tube; and a wall portion extending upward from an outer edge portion of the bottom portion.

7. A submerged pump system comprising:

a pump configured to be submerged in a handling liquid;

a cylindrical pump column configured to accommodate the pump; and the sealing member according to claim 1.

8. The sealing member according to claim 1, wherein a dimensional tolerance of the inner diameter of the tube portion with respect to an outer diameter dimension of the lift shaft is smaller than a dimensional tolerance of the diameter of the through hole with respect to the outer diameter dimension of the lift shaft.

* * * * *